US009073073B2

(12) United States Patent
Miyajima et al.

(10) Patent No.: US 9,073,073 B2
(45) Date of Patent: Jul. 7, 2015

(54) FLOW PATH MEMBER, LIQUID EJECTING HEAD AND LIQUID EJECTING APPARATUS

(71) Applicant: Seiko Epson Corporation, Tokyo (JP)

(72) Inventors: Hiroki Miyajima, Matsumoto (JP); Koji Morikoshi, Shiojiri (JP)

(73) Assignee: Seiko Epson Corporation (JP)

( * ) Notice: Subject to any disclaimer, the term of this patent is extended or adjusted under 35 U.S.C. 154(b) by 369 days.

(21) Appl. No.: 13/726,755

(22) Filed: Dec. 26, 2012

(65) Prior Publication Data

US 2013/0161422 A1 Jun. 27, 2013

(30) Foreign Application Priority Data

Dec. 27, 2011 (JP) ..... 2011-286918
Dec. 27, 2011 (JP) ..... 2011-286919

(51) Int. Cl.
*B41J 2/045* (2006.01)
*B05B 1/34* (2006.01)
*B41J 2/175* (2006.01)

(52) U.S. Cl.
CPC . *B05B 1/34* (2013.01); *B41J 2/175* (2013.01); *B41J 2/17596* (2013.01)

(58) Field of Classification Search
CPC ..... B41J 2/175; B41J 2/17596; B05B 1/30; B05B 1/34; F16K 31/12; F16K 31/36; F16K 31/365
See application file for complete search history.

(56) References Cited

U.S. PATENT DOCUMENTS 7,500,618 B2 * 3/2009 Fujishiro et al. ..... 239/91
2010/0020140 A1 * 1/2010 Yokouchi ..... 347/85

FOREIGN PATENT DOCUMENTS

EP 1 445 105 B1 11/2002
JP 2005-186344 7/2005
JP 2008-230196 10/2008
WO WO03/041964 5/2003

* cited by examiner

*Primary Examiner* — Juanita D Jackson
(74) *Attorney, Agent, or Firm* — Harness, Dickey & Pierce, P.L.C.

(57) ABSTRACT

A pressure chamber in which an opening of a groove-shaped flow paths configuring a portion of a liquid flow path is formed by sealing with a film, a valve body which opens and closes a communication path communicating with the pressure chamber, and a pressure receiving member which is pressed by the film displaced to the pressure chamber side by negative pressure of the pressure chamber and is able to press the valve body in a direction where the valve body is valve opening state are included, and the valve body includes a flange section, a shaft section connected to the flange section and a seal member, and the seal member is formed in a shape of an annulus surrounding the shaft section.

20 Claims, 18 Drawing Sheets

FLOW PATH MEMBER, LIQUID EJECTING HEAD AND LIQUID EJECTING APPARATUS

BACKGROUND

1. Technical Field

The present invention relates to a flow path member, a liquid ejecting head and a liquid ejecting apparatus.

2. Related Art

As a liquid ejecting apparatus ejecting liquid from a nozzle of a liquid ejecting head to a target, for example, an ink jet type recording apparatus (hereinafter, simply referred to as "a recording apparatus") ejecting ink droplets from a nozzle of an ink jet type recording head (hereinafter, simply referred to as "a recording head") is well known.

The recording head is configured of a head body ejecting a ink and a flow path member to which the ink is supplied from an ink reservoir unit such as an ink cartridge and through which the ink is supplied to the head body. The flow path member has, for example, a pressure adjustment unit adjusting the pressure of the ink to be supplied to the head body to be in a predetermined range.

The pressure adjustment unit is configured in such a manner that for example, a pressure chamber is formed by sealing an opening of a groove-shaped flow path with a film and a communication path communicating with the pressure chamber is opened and closed by a valve body due to pressure variation in the pressure chamber (see JP-A-2008-230196).

The valve body has a seal member coming in contact with an opening edge of the communication path. The communication path may be reliably closed using the valve body with the seal member.

However, whenever the valve body opens and closes the communication path due to the pressure variation in the pressure chamber, the ink is gradually accumulated on the opening edge of the communication path. When the accumulation of the ink progresses, the opening-closing operation of the valve body is unstable. For example, the opening degree of the valve body is varies according to an accumulation amount of the ink, even though the same degree of pressure variation occurs in the pressure chamber. Thus, the supply of the ink to the head body is unstable, ejection characteristics of the ink vary and then printing quality is degraded. In addition, when the accumulation of the ink progresses further, sealing by the seal member may be incomplete, even in a state where the valve body closes the communication path. In this case, there is concern that the ink may be ejected from the nozzle of the head body at an unintended timing.

In addition, the problem described above is not limited to the flow path member for the ink jet type recording head and similarly exists in a flow path member which supplies liquid other than the ink to another member. In addition, the problem described above is not limited to the ink jet type recording head and similarly exists in a liquid ejecting head and a liquid ejecting apparatus ejecting the liquid other than the ink.

SUMMARY

An advantage of some aspects of the invention is to provide a flow path member where an opening-closing operation of a valve body is stabilized by suppressing accumulation of the liquid on an opening edge of a communication path communicating with a pressure chamber, and supply of the liquid can be stably performed, a liquid ejecting head and a liquid ejecting apparatus in which ejection characteristics of a liquid are made stable by using the flow path member.

According to an aspect of the invention, there is provided a flow path member including: a liquid flow path through which a liquid flows; a groove-shaped flow path configuring a portion of the liquid flow path and a communication path communicating with the groove-shaped flow path; a flexible member which forms a pressure chamber in the groove-shaped flow path by sealing an opening of the groove-shaped flow path and is flexibly deformed by pressure variation inside the pressure chamber; a valve body which has a shaft section inserted through the communication path and a valve main body provided on the shaft section, is able to enter a valve closing state in which the valve main body closes the communication path and a valve opening state in which the valve main body is separated from the communication path, and is biased to be in the valve closing state; and a pressure receiving member which is displaced by receiving a pressing force from the flexible member due to displacement of the flexible member to the pressure chamber side and then is able to press the shaft section in a direction where the valve body enters the valve opening state, wherein the valve body is able to rotate around the shaft center, the valve main body is provided with, a seal member which comes in contact with an opening edge of the communication path, and the seal member is formed in a shape of an annulus of which a distance from the shaft section is not constant.

In the aspect, an accumulation of the liquid formed on the opening edge can be spread and thinned so that it is possible to almost completely eliminate the influence of the accumulated liquid with respect to an opening-closing operation of the valve body in the communication path.

Accordingly, the flow path member is configured in such a manner that the operation of the valve body can be stable and the liquid can be stably supplied without the occurrence of variation in the opening-closing operation of the valve body.

According to another aspect of the invention, there is provided a flow path member comprising: a liquid flow path through which a liquid flows; a groove-shaped flow path configuring a portion of the liquid flow path and a communication path communicating with the groove-shaped flow path; a flexible member which forms a pressure chamber in the groove-shaped flow path by sealing an opening of the groove-shaped flow path and is flexibly deformed by pressure variation inside the pressure chamber; a valve body which has a shaft section inserted through the communication path and a valve main body provided on the shaft section, is able to enter a valve closing state in which the valve main body closes the communication path and a valve opening state in which the valve main body is separated from the communication path, and is biased to be in the valve closing state; and a pressure receiving member which is displaced by receiving a pressing force from the flexible member due to displacement of the flexible member to the pressure chamber side and then is able to press the shaft section in a direction where the valve body enters the valve opening state, wherein the valve main body is provided with a seal member which comes in contact with the opening edge of the communication path, and the seal member includes a water-repellent resin to be dissociated when the opening edge is sealed in the valve opening state of the valve body.

In the aspect, the seal member including the water-repellent resin is formed and the water-repellent resin is attached to the opening edge facing the seal member according to an opening-closing operation of the valve body. Thus, liquid attaching to the opening edge is suppressed. Accordingly, the flow path member is configured in such a manner that the operation of the valve body can be stable and the liquid can be stably supplied without the occurrence of variation in the opening-closing operation of the valve body.

It is preferable that the seal member be formed so as to pass through the shaft section in a plane perpendicular to the shaft section and to be line symmetrical with respect to two shafts perpendicular to each other. Accordingly, the bias force biasing the valve body is evenly applied to the entire seal member and the sealing with the opening edge is improved.

In addition, it is preferable that the water-repellent treatment be performed on the surface of the opening edge of the communication path. Accordingly, the liquid fixing to the opening edge can be further reliably prevented.

It is preferable that the seal member be formed in a shape of an annulus and the center of the annulus is shifted from the shaft section. Accordingly, the accumulation of the liquid formed on the opening edge can be further reliably spread and thinned.

In addition, it is preferable that the valve body and the seal member be two-color molded. Accordingly, the valve body, in which the bonding strength of the seal member is improved, is obtained.

It is preferable that the seal member be formed in a wave shape configured of a portion protruding to the shaft section side and a portion protruding outwardly further than the shaft section. Accordingly, the accumulation of the liquid formed on the opening edge can be further reliably spread and thinned.

In addition, it is preferable that the valve body and the seal member be integrally molded. Accordingly, the manufacturing of the valve body can be simplified.

It is preferable that the shaft section be provided with a screw which is pressed against the pressure receiving member and then rotates the valve body. Accordingly, the rotation of the valve body is promoted so that the accumulation of the liquid formed on the opening edge can be further reliably spread and thinned.

In addition, it is preferable that the water-repellent resin be silicon oil or fluorine resin. Accordingly, the silicon oil or the fluorine resin can be used as the water-repellent resin having water-repellency.

In addition, it is preferable that the valve body be provided with a groove which receives the pressure of the liquid in the liquid flow path and then rotates the valve body on the side surface thereof. Accordingly, the rotation of the valve body is promoted so that the accumulation of the liquid formed on the opening edge can be further reliably spread and thinned.

In addition, it is preferable that the liquid flow path include a valve body accommodating chamber which communicate with the communication path so as to accommodate the valve body, and the valve body accommodating chamber is provided with a groove in which the liquid circles from the valve body accommodating chamber to the communication path on the side surface thereof. Accordingly, the rotation of the valve body is promoted so that the accumulation of the liquid formed on the opening edge can be further reliably spread and thinned.

In addition, according to still another aspect of the invention, there is provided a liquid ejecting head including the flow path member; and a head main body ejecting the liquid supplied from the flow path member.

In the aspect, the liquid ejecting head is provided in which the ejection characteristics of the liquid are stable.

Further, according to still another aspect of the invention, there is provided a liquid ejecting apparatus including the liquid ejecting head.

In the aspect, the liquid ejecting apparatus is provided in which the ejection characteristics of the liquid are stable.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, the invention is described in detail based on the embodiments. An ink jet type recording head is an example of a liquid ejecting head and simply referred to as a recording head. In addition, an ink jet type recording apparatus is an example of a liquid ejecting apparatus. Further, it is assumed that the directions shown by each arrow represented by "front", "right" and "up" in each drawing indicates "front-back direction", "right-left direction" and "up-down direction", respectively.

Figure 1:
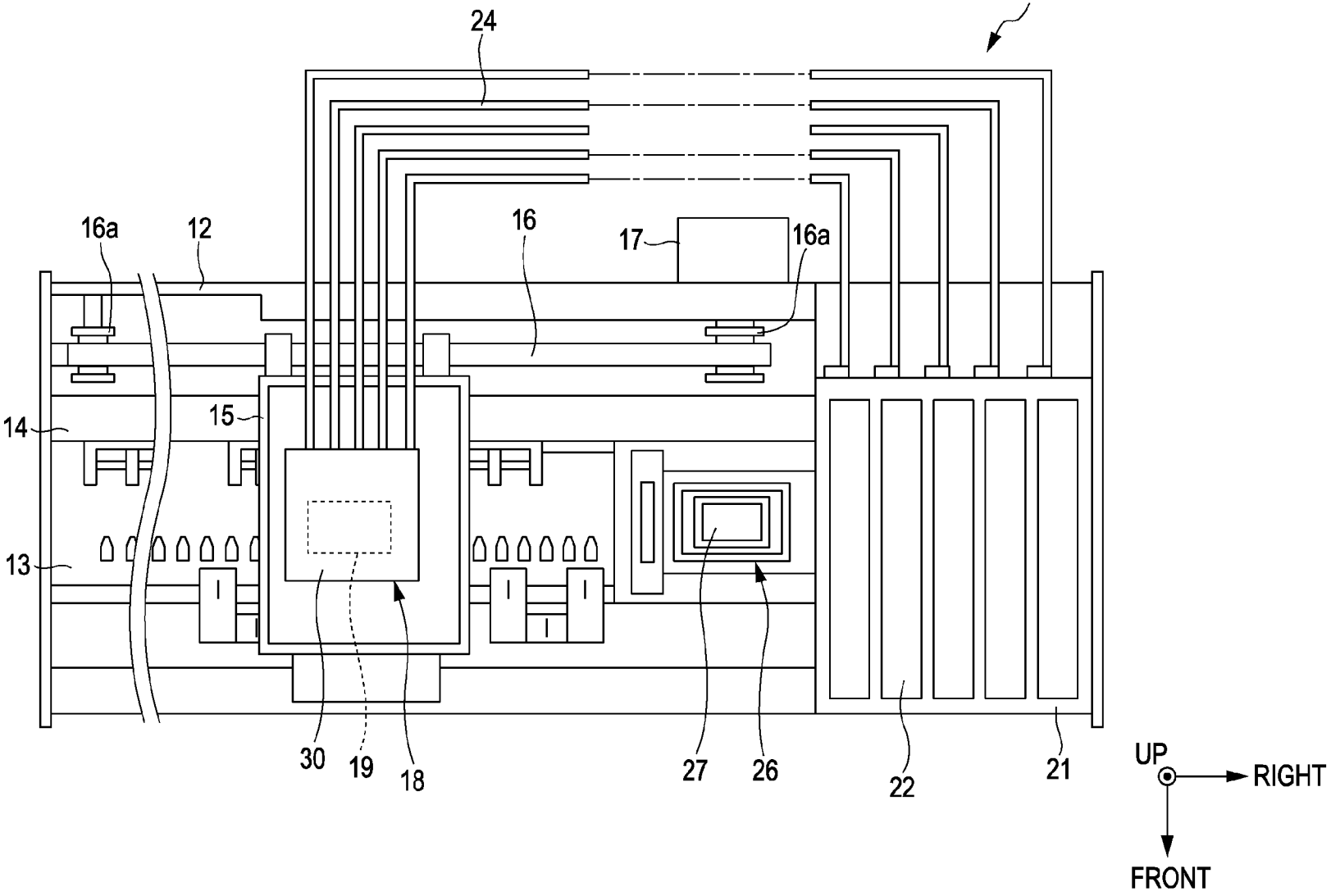
FIG. 1 is a plan view of an ink jet type recording apparatus.

FIG. 1 is a plan view of an ink jet type recording apparatus. As shown in FIG. 1, an ink jet type recording apparatus 11 includes a body frame 12 having a rectangular shape in plan view. A platen 13 is extended in the right-left direction, which is a main scanning direction in the body frame 12. On the platen 13, a recording sheet (not shown) is fed by a paper feeding mechanism (not shown) along the front-back direction which is a sub-scanning direction. In addition, a rod-shaped guide shaft 14 which is extended parallel in the longitudinal direction (the right-left direction) of the platen 13 is provided in a hanging manner upward from the platen 13 in the body frame 12.

A carriage 15 is supported on the guide shaft 14 in a state where reciprocating movement thereof is possible along the guide shaft 14. The carriage 15 is connected to a carriage motor 17, which is provided at a back surface of the body frame 12, via an endless timing belt 16 hung between a pair of pulleys 16*a* which is provided in the inside of back wall of the body frame 12. Accordingly, the carriage 15 is reciprocated along the guide shaft 14 by the drive of the carriage motor 17.

A recording head 18 is supported at a lower end side facing the platen 13 in the carriage 15. The recording head 18 includes a head body 19 ejecting the ink and a flow path member 30 supplying the ink from the ink cartridge 22 to the head body 19.

Plural nozzles (not shown) are opened to the lower surface of a head body 19. Ink droplets are ejected respectively from each nozzle to a recording paper (not shown) fed on the platen 13 by driving a piezoelectric element (not shown) provided in the head body 19 and then the printing is performed.

A carriage holder 21 is provided on a right end portion in the body frame 12 and plural ink cartridges 22 are detachably mounted on the carriage holder 21 as a liquid supply source. In the embodiment, five ink cartridges 22 are provided. Different (color) types of ink are accommodated in each ink cartridge 22.

Each ink cartridge 22 mounted on the carriage holder 21 is connected to the flow path member 30 via each ink supply tube 24. Each color of ink, which is supplied from the respective ink cartridges 22 via the respective ink supply tubes 24, is temporarily stored in the flow path member 30. Each color of ink temporarily stored individually is supplied to the head body 19.

A maintenance unit 26 for performing maintenance such as cleaning of the head body 19 is provided at a home position region of the carriage 15, that is at a position closer to the right end portion in the body frame 12. The maintenance unit 26 includes a cap 27 which comes in contact with the head body 19 so as to surround the opening of each nozzle of the head body 19 and accommodates the ink ejected by flushing from the opening of each nozzle, and a suction pump (not shown) which is capable of suctioning the inside of the cap 27.

Thus, thickened ink, bubbles or the like is forcibly discharged from the opening of each nozzle into the cap 27, that is, a cleaning is performed, by suctioning the inside of the cap 27 using a suction pump (not shown) in a state where the head body 19 comes in contact with the cap 27 so as to surround the opening of each nozzle of the head body 19.

Figure 2:
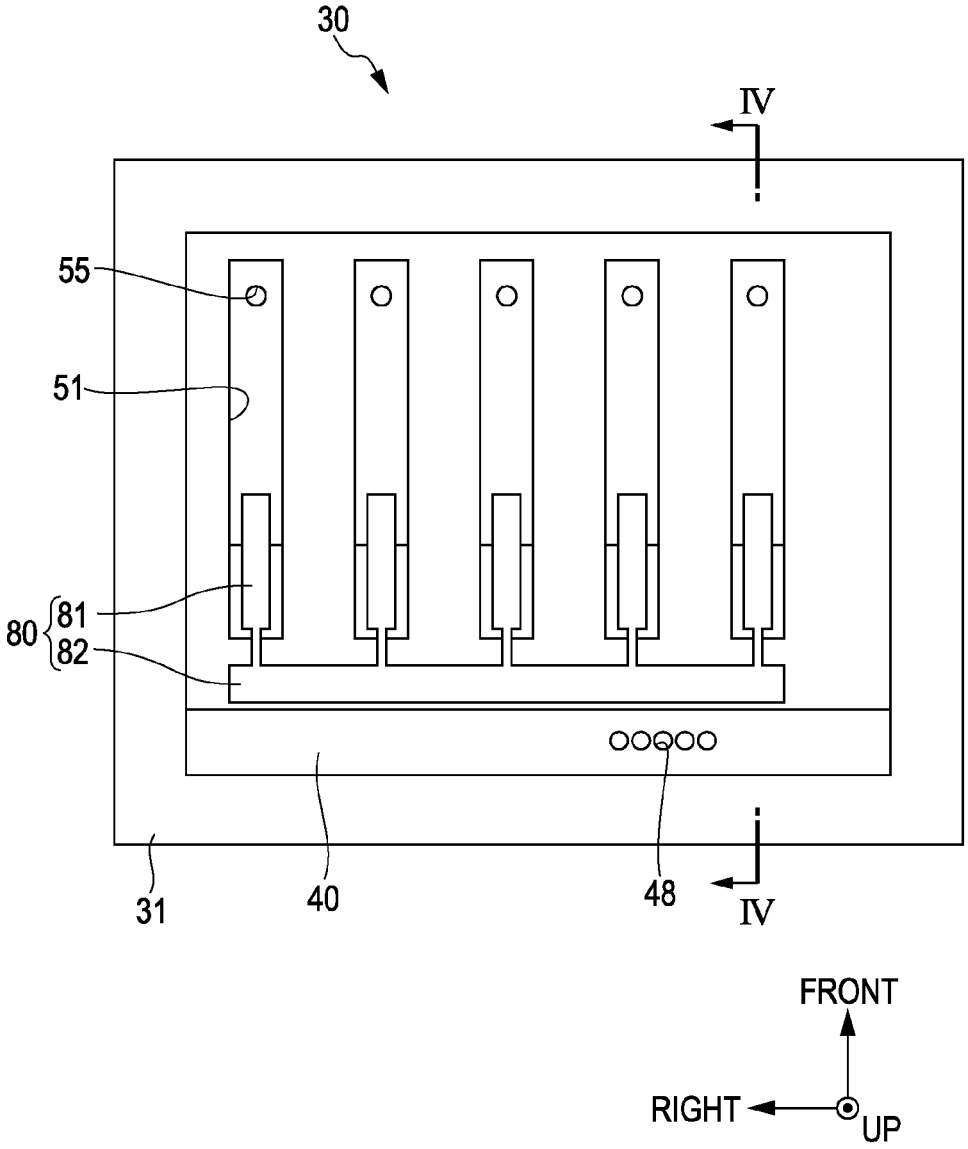
FIG. 2 is a plan view of a flow path member (in a state that the cover member is removed).
Figure 3:
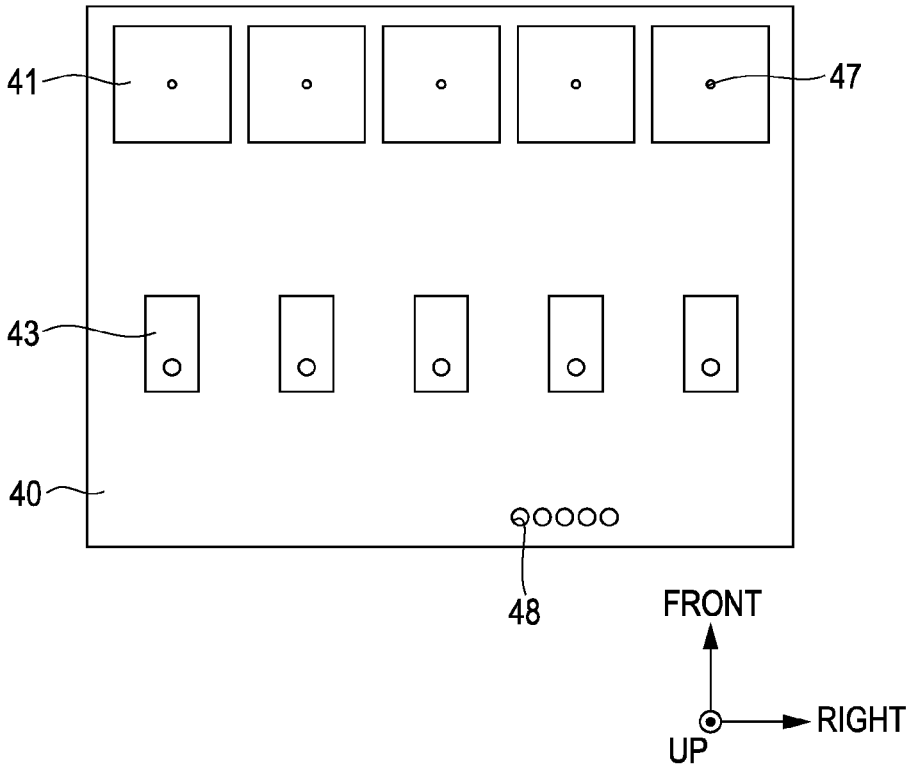
FIG. 3 is a plan view of a first flow path member.
Figure 4:
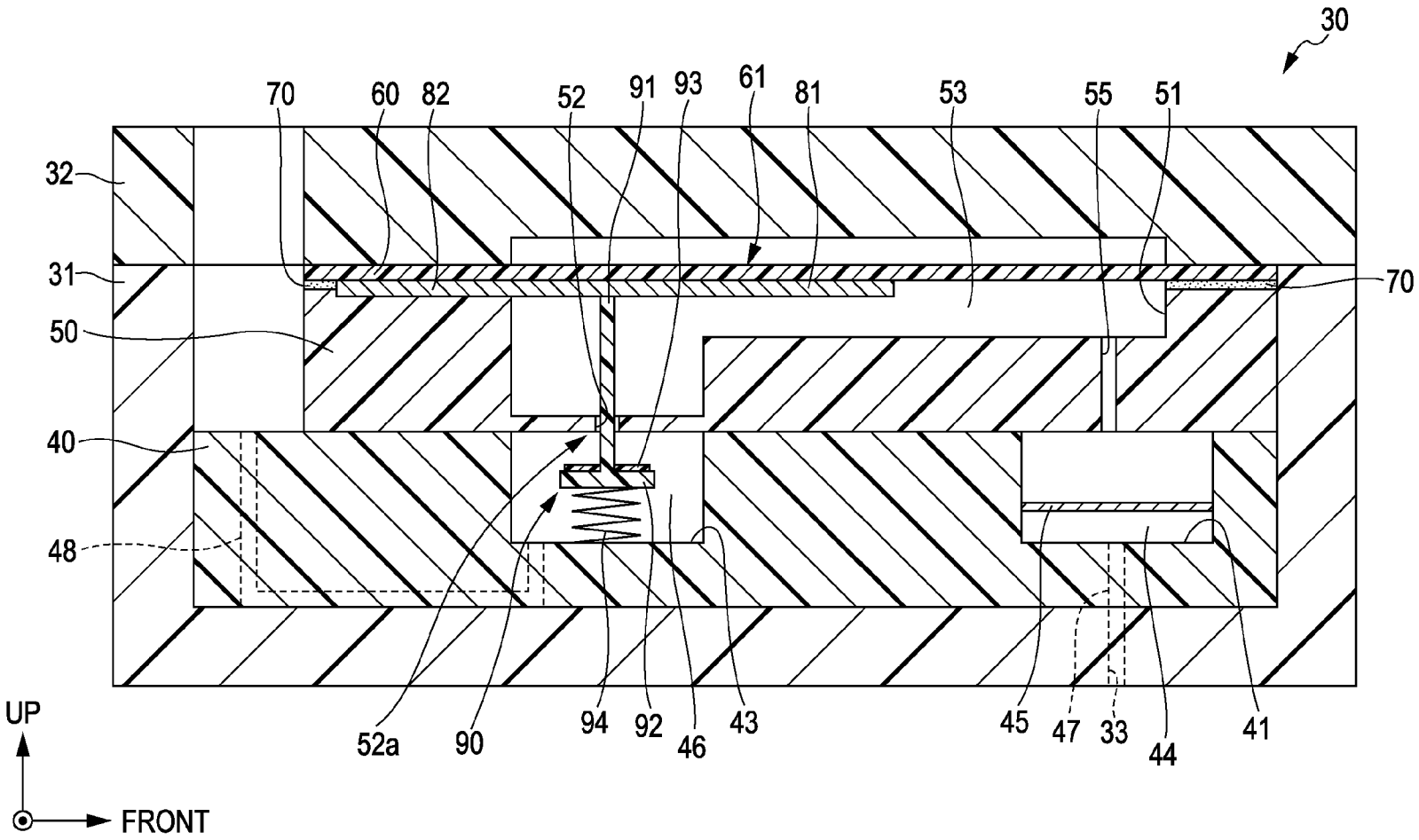
FIG. 4 is a cross-sectional view taken along the line IV-IV in FIG. 2.

FIG. 2 is a plan view of the flow path member (in a state where a cover member and a film are removed) according to the embodiment, FIG. 3 is a plan view of a first flow path member 40 according to the embodiment and FIG. 4 is a cross-sectional view taken along the line IV-IV in FIG. 2.

As shown in the drawings, the flow path member 30 includes a square box-shaped holding member 31 having a bottom, a cover member 32 capable of sealing an upper opening of the holding member 31, a first flow path member 40 and a second flow path member 50 which are received in the holding member 31.

An inner bottom surface of the holding member 31 and a lower surface of the first flow path member 40, an upper surface of the first flow path member 40 and a lower surface of the second flow path member 50, and an upper surface of the holding member 31 and a lower surface of the cover member 32 are respectively bonded to each other by an adhesive. In addition, the holding member 31, the cover member 32, the first flow path member 40 and the second flow path member 50 have stiffness and are configured of a synthetic resin through which the liquid does not pass.

As shown in FIG. 3, plural filter chamber concave sections 41 are provided in the front end side (an end portion in the front direction) on the upper surface of the first flow path member 40. In the embodiment, five filter chamber concave sections 41 are arranged in a line in the right-left direction depending on the type of ink used.

In addition, valve body concave sections 43, in which valve bodies 90 (described in detail below) are disposed, are provided in a line in the right-left direction at the back end side in the inner bottom surface of the first flow path member 40. In the embodiment, one valve body concave section 43 is provided on one filter chamber concave section 41 and a total of five valve body concave sections 43 is provided in a line in the right-left direction.

As shown in FIGS. 2 to 4, a filter chamber 44 and a valve body accommodating chamber 46 are formed by laminating the second flow path member 50 on the upper surface of the first flow path member 40.

The filter chamber 44 is a space surrounded by each filter chamber concave sections 41 and the second flow path member 50, and, in the embodiment, five filter chambers 44 are formed. In addition, the valve body accommodating chamber 46 is a space surrounded by the valve body concave sections 43 and the second flow path member 50, and in the embodiment, five valve body accommodating chambers 46 are formed.

A filter 45 has substantially the same shape as the opening shape of the filter chamber concave sections 41 and is arranged so as to cross in the up-down direction in which the ink of the filter chamber concave section 41 flows. A foreign material or the like, which is included in each ink flowing from the upstream side, is removed using the filter 45. In addition, the filter 45 may be formed by finely weaving metal or may be formed of a metal plate or a nonwoven fabric where fine single hole is provided.

An outlet hole 47 is opened to the bottom surface of each filter chamber 44 so as to drain the ink, in which the foreign material or the like is removed by the filter 45, to the head body 19 (see FIG. 1) side positioned at the downstream side. The outlet hole 47 communicates with a communicating hole 33 that is a through hole formed on the bottom surface of the holding member 31, and the ink is drained to the head body 19 via the communicating hole 33.

In addition, an ink introduction path 48, in which the ink supplied from the ink supply tube 24 (see FIG. 1) is introduced, is formed at the first flow path member 40. An opening of one side of the ink introduction path 48 is formed on the upper surface of the first flow path member 40 and an opening of the other side is formed on the bottom surface of the valve body accommodating chamber 46.

Five groove-shaped flow paths 51, which configure a portion of the liquid flow path formed on the flow path member 30, are extended in the front-back direction on the upper surface of the second flow path member 50. In the embodiment, five groove-shaped flow paths 51 are provided having substantially the same length as each other in the front-back direction.

The groove-shaped flow path 51 is extended from a region facing the valve body accommodating chamber 46 of the second flow path member 50 to a region facing the filter chamber 44. The back end side of the groove-shaped flow paths 51 communicates with the valve body accommodating chamber 46 via a communication path 52. The front end side of the groove-shaped flow paths 51 communicates with the filter chamber 44 via the communication path 55.

A film (a flexible member) 60 made of a synthetic resin having flexibility is provided on the upper surface of the second flow path member 50.

The film 60 seals the upper opening of the groove-shaped flow paths 51 and a pressure chamber 53 is a space formed by the film 60 and the groove-shaped flow paths 51. The region facing the groove-shaped flow paths 51 of the film 60, in other words, the region configuring one surface of a pressure chamber 53 is referred to as a pressure receiving section 61. The opening shapes of each of groove-shaped flow paths 51 are the same as each other so that the pressure receiving sections 61 also have the same shape as each other. The pressure receiving section 61 of the film 60 is elastically deformed by a difference between the atmosphere and the pressure in the pressure chamber 53. Since the pressure in the pressure chamber 53 becomes negative with respect to the atmosphere, the pressure receiving section 61 is flexed to the inner side of the pressure chamber 53.

In the embodiment, the film 60 is one sheet of film covering the entire upper surface of the second flow path member 50. The film 60 is bonded to the opening edge of the groove-shaped flow paths 51 of the upper surface of the second flow path member 50 using adhesive 70. Of course, the film 60 may be bonded to the entire upper surface of the second flow path member 50 using an adhesive, and not just the opening edge. In addition, film 60 does not need to be formed in one sheet and may be formed for each groove-shaped flow path 51.

As described above, the liquid flow path configured of the ink introduction path 48, the valve body accommodating chamber 46, the communication path 52, the pressure chamber 53, the communication path 55, the filter chamber 44, the outlet hole 47 and the communicating hole 33 is provided on the flow path member 30. The ink supplied from each ink supply tube 24 (see FIG. 1) flows in the liquid flow path of the flow path member 30 and then is supplied to the head body 19. In addition, the communication path 52 corresponds to a communication path communicating with the groove-shaped flow path (the pressure chamber) disclosed in the claims.

A pressure receiving member 80 is arranged between the second flow path member 50 and the film 60. The pressure receiving member 80 is displaced by receiving a pressing force from the film due to the displacement of the film toward the pressure chamber 53 side and is intended to press a valve body 90 described below.

Specifically, the pressure receiving member 80 is configured of five operation plates 81 and a base end section 82 to which each of the operation plates 81 is commonly connected. The material of the pressure receiving member 80 is not specifically limited and in the embodiment, the pressure receiving member 80 is formed of one sheet of a thin plate made of a stainless steel having appropriate elasticity. The operation plates 81 is formed in such a manner that the width thereof is slightly narrower than that of the pressure chamber 53 and the length thereof is long in the front-back direction.

The pressure receiving member 80 is bonded to the upper surface of the second flow path member 50 at the base end section 82 and the upper surface thereof is covered by the film 60. Thus, the base end section 82 of the pressure receiving member 80 is pinched between the second flow path member 50 and the cover member 32. In addition, each of operation plates 81 is arranged so as to face the pressure receiving section 61 in plan view and is separated from the bottom portion of the groove-shaped flow paths 51. In other words, the pressure receiving member 80 has a cantilever structure in which the base end section 82 is a fixed end and the operation plate 81 is a free end.

The valve body 90 is provided below the pressure receiving member 80. The valve body 90 is configured in such a manner that it is possible for the valve body 90 to enter a valve closing state in which the ink does not flow in the pressure chamber 53 and enter a valve opening state in which the ink flows in the pressure chamber 53, and the valve body 90 is biased so as to be in the valve closing state.

Figure 5A:
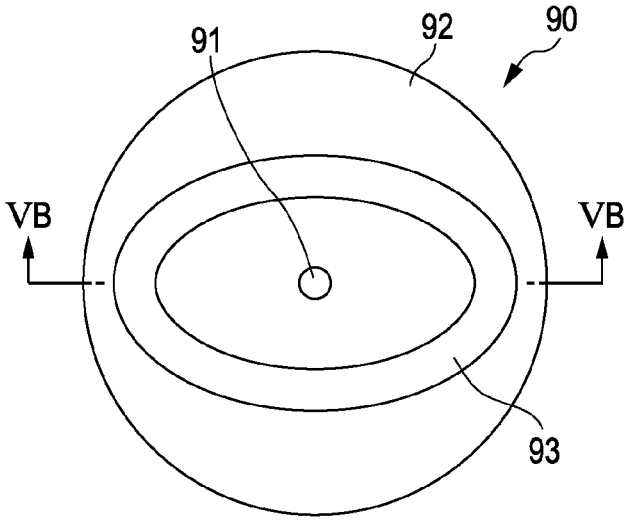
FIG. 5A is a plan view of a valve body and FIG. 5B is a cross-sectional view of the valve body taken along the line VB-VB in FIG. 5A.
Figure 5B:
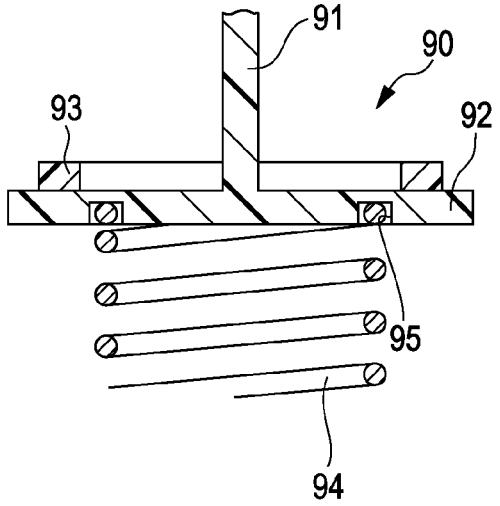
Figure 6A:
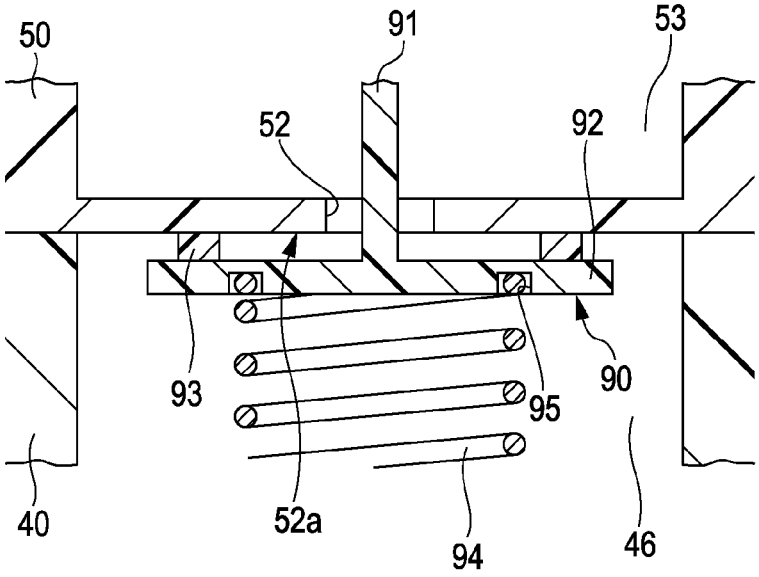
FIGS. 6A and 6B are cross-sectional views of a main portion illustrating opening-closing operation of the valve body.
Figure 6B:
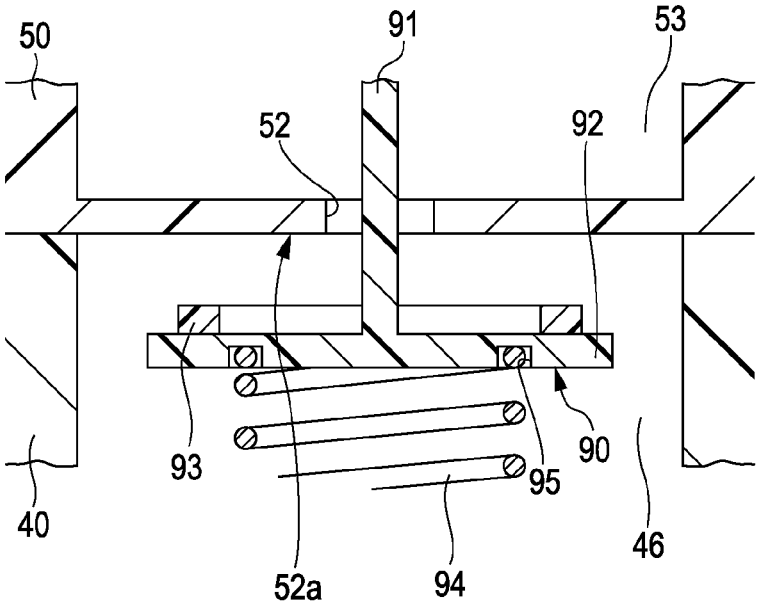

The valve body 90 is described in detail using FIGS. 4 to 6B. FIGS. 5A and 5B are a plan view and a cross-sectional view of the valve body, respectively, and FIGS. 6A and 6B are cross-sectional views illustrating the opening-closing operation of the valve body, respectively.

As shown in FIG. 4, the valve body 90 includes a cylindrical shaft section 91, a disc-shaped flange section 92 and a seal member 93. The flange section 92 is an example of the valve main body in the aspects of the invention. The outer diameter of the shaft section 91 is smaller than the inner diameter of the communication path 52 and the shaft section 91 is inserted through the communication path 52. In addition, the outer diameter of the flange section 92 is larger than the inner diameter of the communication path 52 and the flange section 92 is arranged in the valve body accommodating chamber 46. The lower end of the shaft section 91 is connected to the center of the upper surface of the flange section 92 and the upper end of the shaft section 91 comes into contact with the lower surface of the operation plate 81.

In addition, the film 60 does not need to come in constant contact with the operation plate 81, and if the operation plate 81 is pressed due to the displacement of the film 60, the film 60 and the operation plate 81 may be separated. Similarly, if the valve body 90 is pressed due to the displacement of the operation plate 81, the operation plate 81 does not need to come in contact with the valve body 90 and they may be separated.

As shown in FIGS. 5A and 5B, the seal member 93 which is configured of elastic material is fixed to the upper surface of the flange section 92. The seal member 93 comes in contact with an opening edge 52*a* (see FIG. 4) of the communication path 52 and performs sealing between the flange section 92 and the opening edge 52*a*. The seal member 93 is formed in a shape of an annulus of which the distance from the shaft section 91 is not constant. That is, as shown in FIG. 5A, the seal member 93 is continued without a break so as to surround the shaft section 91 and the distance from the shaft section 91 is not constant. In other words, the seal member 93 is formed in the shape of the annulus concentric with the shaft section 91. In addition, the height (the height from the upper surface of the flange section 92) of the seal member 93 is constant. In the embodiment, the seal member 93 is formed in an oval shape so as to surround the shaft section 91. Since the seal member 93 has such a shape, the ink can be prevented from being accumulated on the opening edge 52*a* as described below in detail.

Furthermore, the seal member 93 passes through the shaft section 91 on the upper surface of the flange section 92 that is a plane perpendicular to the shaft section 91 and is formed to be line symmetrical with respect to two axes (one is illustrated in the line VB-VB and the other is perpendicular to the line VB-VB) which are perpendicular to each other. The seal member 93 has a shape such that a bias force by a coil spring 94 is applied constantly to the entire seal member 93 and sealing with the opening edge 52*a* can be improved as described in detail below.

In addition, as shown in FIGS. 4 and 5B, the coil spring 94 which is an example of a biasing member is intervened between the lower surface of the flange section 92 and the bottom surface of the valve body accommodating chamber 46. One end of the coil spring 94 is fixed to the bottom surface of the valve body accommodating chamber 46 and the other end thereof is engaged in a groove 95 provided on the lower surface of the flange section 92. The groove 95 is formed in a circular shape around the shaft section 91. The flange section 92 is slidably formed with respect to the coil spring 94. Accordingly, the entire valve body 90 can move up and down due to the expansion and contraction of the coil spring 94, and is rotatably formed around the shaft section 91.

The opening-closing operation of the valve body 90 having such a configuration is described. As shown in FIG. 6A, the coil spring 94 is biased in an upward direction which makes the valve body 90 always be in the valve closing state. Thus, in the valve closing state of the valve body 90, the seal member 93 closely comes in contact with the opening edge 52*a* of the communication path 52 in a state of surrounding the communication path 52. Accordingly, the communication path 52 is closed, that is, the inside of the valve body accommodating chamber 46 and the inside of the pressure chamber 53 are in a non-communication state. Further, as described above, since the seal member 93 is formed so as to be line symmetrical with respect to two axes perpendicular to each other (see FIGS. 5A and 5B), the bias force of the coil spring 94 is applied constantly to the entire seal member 93 and the sealing with the opening edge 52*a* is improved.

In a state where the ink is supplied to the liquid flow path due to initial charging or the preceding ejecting of the ink, when each ink is ejected from the head body 19 (see FIG. 1), the ink in each pressure chamber 53 decreases. Accordingly, each pressure chamber 53 becomes a negative pressure due to the pressure difference with the atmosphere, and then the pressure receiving section 61 (see FIG. 4) is displaced to be bent to the pressure chamber 53 side (the lower side). Each operation plate 81 (see FIG. 4) is pressed by the pressure receiving section 61 and then is elastically deformed. Further, each valve body 90 is pressed by the operation plate 81 and then pushed down.

As shown in FIG. 6B, when the valve body 90 is pushed down against the bias force of the pressure coil spring 94, the valve body 90 becomes the valve opening state. In other words, the seal member 93 is separated from the opening edge 52*a* and then the valve body 90 is opened. Thus, when the valve body 90 is in the valve opening state, the communication path 52 is opened, that is, the inside of the valve body accommodating chamber 46 and the inside of the pressure chamber 53 enter the communication state.

When the valve body 90 is the valve opening state, the ink in each valve body accommodating chamber 46 flows in each pressure chamber 53 via the communication path 52. Thus, when the ink is sufficiently replenished in each pressure chamber 53, the negative pressure in each pressure chamber 53 is eliminated and then each pressure receiving section 61 and each operation plate 81 return to their respective original positions. In addition, each valve body 90 is in the valve closing state respectively due to the bias force of each coil spring 94 and then each pressure chamber 53 is always maintained at a constant pressure.

Figure 7A:
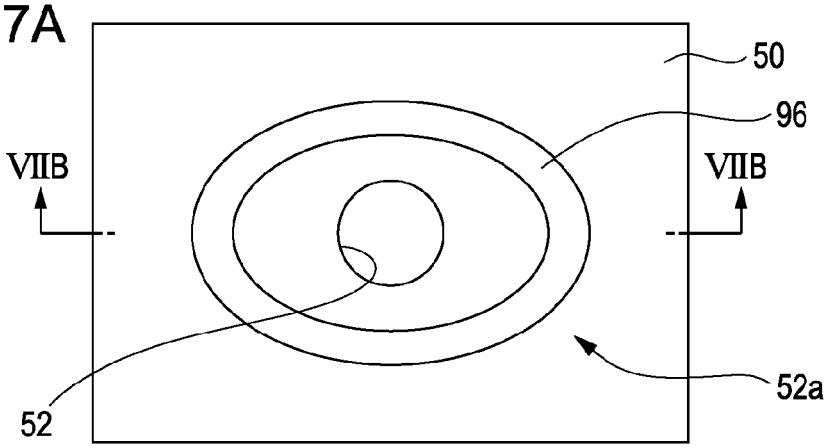
FIGS. 7A and 7C are plan views of a communication path which is seen from a valve body accommodating chamber side and FIG. 7B is a cross-sectional view of the communication path taken along the line VIIB-VIIB in FIG. 7A.
Figure 7B:
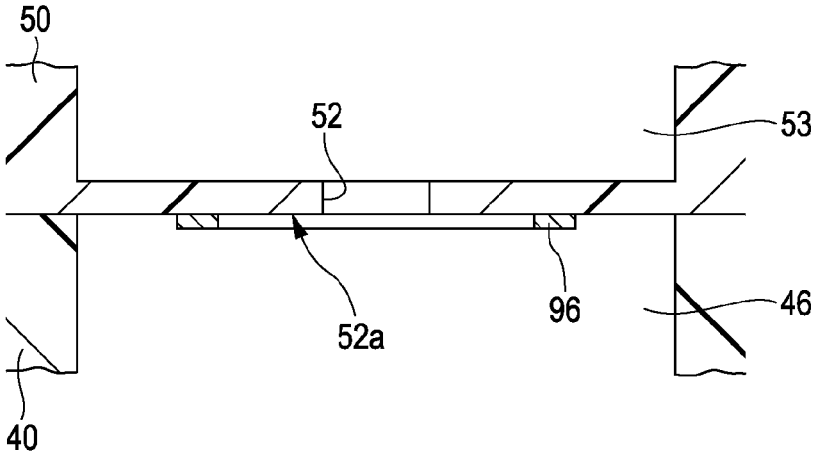
Figure 7C:
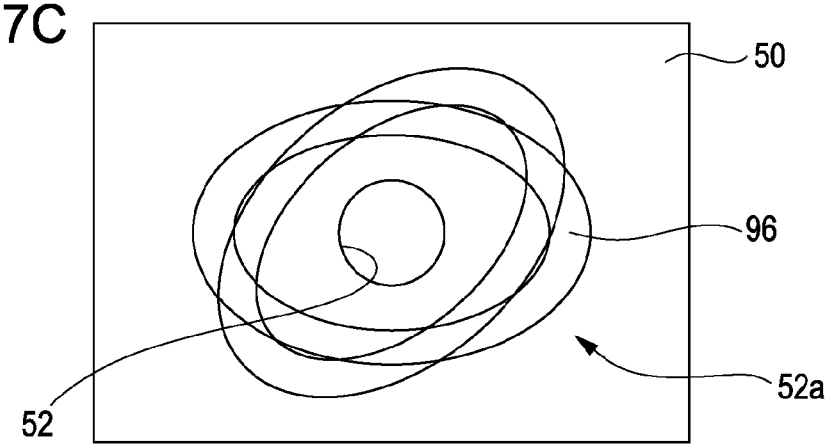
Figure 8A:
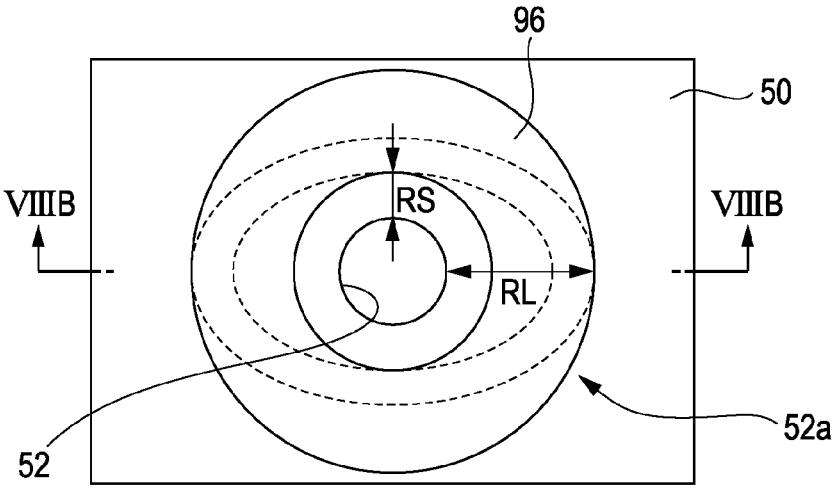
FIG. 8A is a plan view of the communication path which is seen from the valve body accommodating chamber side and FIG. 8B is a cross-sectional view of the communication path taken along the line VIIIB-VIIIB in FIG. 8A.

Here, it that accumulation of the ink on the opening edge 52*a* can be suppressed using the seal member 93 described above is described in detail. FIGS. 7A, 7C and 8A are plan views of the communication path 52 communicating with the pressure chamber 53 seen from the valve body accommodating chamber 46 side. FIG. 7B is a cross-sectional view taken along the line VIIB-VIIB in FIG. 7A, FIG. 8B is a cross-sectional view taken along the line VIIIB-VIIIB in FIG. 8A.

First, as shown in FIGS. 7A and 7B, the seal member 93 (see FIGS. 5A and 5B) comes in contact with the opening edge 52*a* due to the opening-closing operation of the valve body 90 (see FIGS. 4 to 6B). As described above, since the seal member 93 is formed in an oval shape, the ink begins to be accumulated in the same shape as the oval shape thereof on the opening edge 52*a*. The ink accumulated on the opening edge 52*a* is referred to as accumulated ink 96.

As described above, the valve body 90 is rotatably formed around the shaft section 91. Accordingly, the valve body 90 is slightly rotated whenever the valve body 90 performs the opening-closing operation (the up-down movement) and the seal member 93 is also rotated due to the rotation of the valve body 90. Since the seal member 93 is formed in an oval shape, as shown in FIG. 7C, the position of the accumulated ink 96, which is accumulated in a position where the seal member 93 comes in contact with the opening edge 52*a*, is different from the position shown in FIG. 7A. In the example shown in FIG. 7C, the accumulated ink 96 is formed in the oval shape of which the long axis is extended from the upper right to the lower left.

Figure 8B:
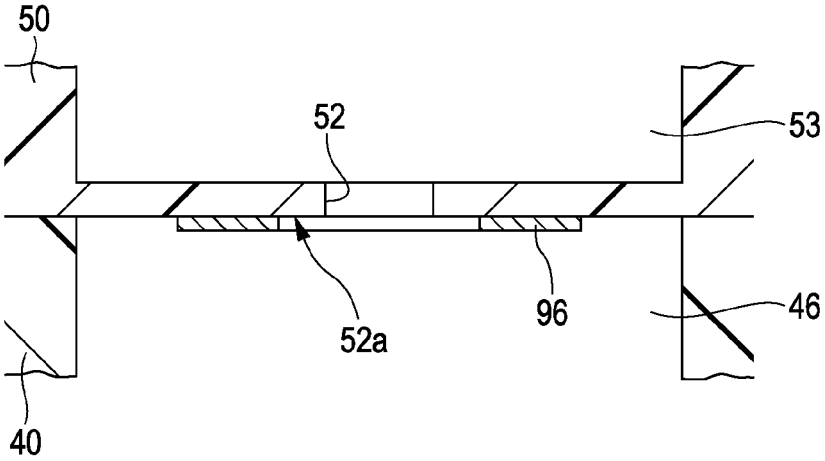

Hereinafter, as shown in FIGS. 8A and 8B, since the valve body 90 is rotated whenever the valve body 90 repeats the opening-closing operation, the accumulated ink 96 formed using the seal member 93, which is rotated, can be relatively spread and thinned. As shown in FIG. 8A, the accumulated ink 96 is formed in a donut shape around the communication path 52. The radius of the outer periphery thereof is the radius RL of the long axis of the oval-shaped seal member 93 and the radius of the inner periphery thereof is the radius RS of the short axis of the seal member 93.

Figure 9A:
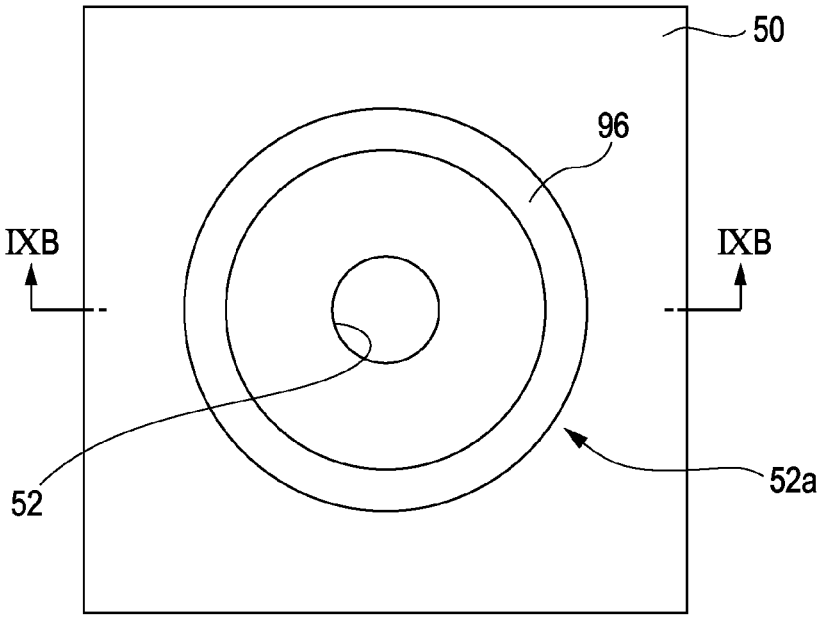
FIG. 9A is a plan view of the communication path which is seen from the valve body accommodating chamber side and FIG. 9B is a cross-sectional view of the communication path taken along the line IXB-IXB in FIG. 9A.
Figure 9B:
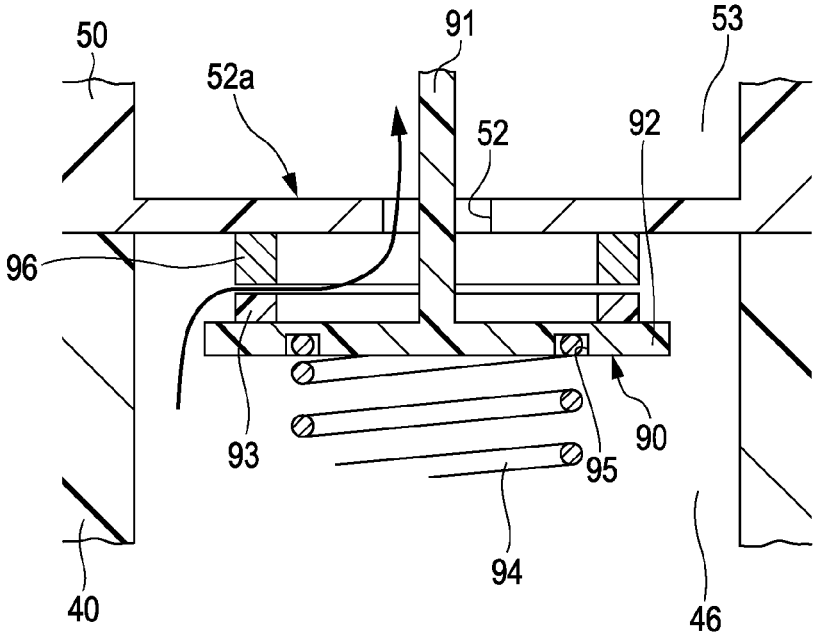

If the seal member 93 is formed in the shape of the annulus around the shaft section 91, in other words, when the seal member 93 is formed in the shape of the annulus in which the distance from the shaft section 91 is constant, the accumulated ink 96 is formed as shown in FIGS. 9A and 9B. FIG. 9A is a plan view of communication path 52 communicating with the pressure chamber 53 seen from the valve body accommodating chamber 46 side and FIG. 9B is a cross-sectional view taken along the line IXB-IXB in FIG. 9A.

As shown in FIG. 9A, when the seal member 93 is formed in the annular shape of the annulus around the shaft section 91, the accumulated ink 96 formed on the opening edge 52*a* is also formed in the shape of the annulus. Since the distance from the shaft section 91 of the seal member 93 is constant, even though the valve body 90 is rotated, the accumulated ink 96 is continuously accumulated in the same position. Accordingly, as shown in FIGS. 9A and 9B, the accumulated ink is accumulated relatively thick and narrow. Thus, there is a variation in the opening-closing operation of the valve body 90. For example, even though the degrees of pressure fluctuations inside of the pressure chamber 53 are the same as each other, since the accumulated ink 96 is formed relatively thick, the degrees of the opening of the valve body 90 become different from each other. As a result, the supply of the ink to the head body 19 is unstable, ejection characteristics of the ink vary and printing quality is degraded. In addition, when accumulation of the ink is further advanced, as shown in FIG. 9B, the variation of the thickness of the accumulated ink 96 becomes significant and even when the valve body 90 closes the communication path, the sealing is incomplete due to the seal member 93. In this case, there is concern of the ink flowing in the pressure chamber 53 from the valve body accommodating chamber 46 and the ink being ejected from the nozzles of the head body 19 at an unintended timing.

Meanwhile, as described above, in the flow path member 30 according to the invention, the seal member 93 is formed in the shape of the annulus of which the distance from the shaft section 91 is not constant. Thus, as shown in FIGS. 7A to 8B, even though the ink is accumulated on the opening edge 52*a*, the ink spreads in the width direction. In other words, since the accumulated ink 96 spreads at the region between the circle having the radius RL and the circle having the radius RS, the ink is suppressed from being accumulated in the thickness direction. Accordingly, it is possible to almost completely eliminate the influence of the accumulated ink 96 with respect to the opening-closing operation of the valve body 90 in the communication path 52.

Accordingly, the flow path member 30 is configured in such a manner that the variation does not occur in the opening-closing operation of the valve body 90, the operation of the valve body 90 can be stable and the ink can be stably supplied to the head body 19.

Thus, according to the recording head 18 and the ink jet type recording apparatus 11 including the flow path member 30 and the head body 19, since the ink is stably supplied to the head body 19 using the flow path member 30 as described above, the variation in the ejecting speed of the ink ejected from the nozzle or in the weight of the ink droplets which are ejected via each liquid path can be suppressed. Accordingly, the ejection characteristics of the ink are improved so that the recording head 18 and the ink jet type recording apparatus 11, which can perform high quality printing, is provided.

Second Embodiment

In the first embodiment, the seal member 93, which is formed in the shape of the annulus of which the distance is not constant from the shaft section 91, is exemplified as the seal member having an oval shape. However, the seal member 93 is not limited to the shape. Below, other embodiments of the seal member are described. In addition, the same numbers are applied to the same members as in the first embodiment and the duplicated descriptions are omitted.

Figure 10:
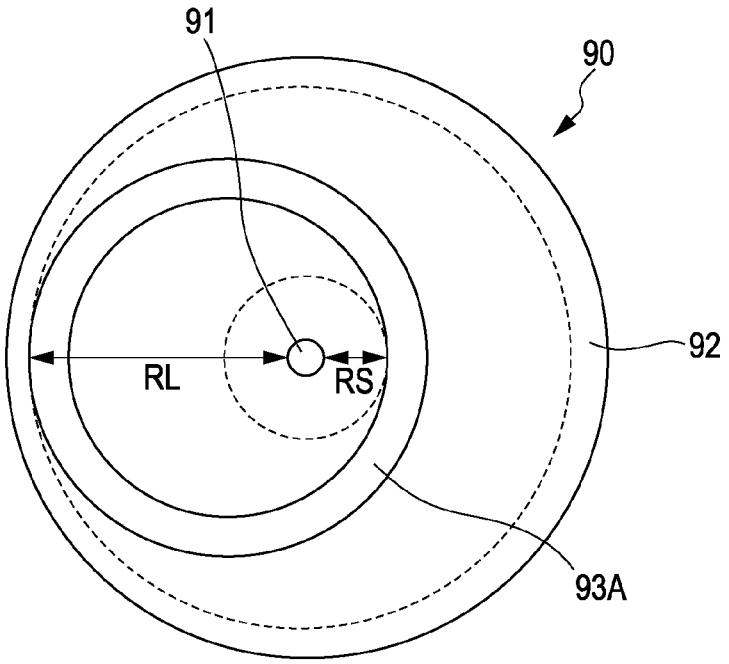
FIG. 10 is a plan view of the valve body.

FIG. 10 is a plan view of the valve body. A seal member 93A is formed in the shape of the annulus so as to surround the shaft section 91. The center of the seal member 93A is shifted from the shaft section 91. In other words, the center of the seal member 93A is eccentric from the shaft section 91.

When the seal member 93A is rotated due to the rotation of the valve body 90, the trace of the seal member 93A is shown in dotted lines. The inside dotted line is a circle having the radius RS which is the shortest distance between the shaft section 91 and the seal member 93A, and an outside dotted line is a circle having the radius RL which is the longest distance between the shaft section 91 and the seal member 93A. Accordingly, a region between two circles is a region where the upper surface of the seal member 93A passes through and accumulated ink 96 is formed on the opening edge 52*a* facing the region.

As described above, the seal member 93A is formed in the shape of the annulus of which the distance from the shaft section 91 is not constant. Accordingly, similar to the first embodiment, even though the ink is accumulated on the opening edge 52*a*, the ink spreads in the width direction. In other words, the accumulated ink 96 spreads at the region between the circle having the radius RL and the circle having the radius RS so that the ink is suppressed from being accumulated in the thickness direction. Accordingly, the influence of the accumulated ink 96 can be almost completely eliminated with respect to the operation in which the valve body 90 opens and closes the communication path 52.

Accordingly, the flow path member 30 is configured so that the operation of the valve body 90 can be stable without the occurrence of variation in the opening-closing operation of the valve body 90 and the ink can be stably supplied to the head body 19.

Figure 11A:
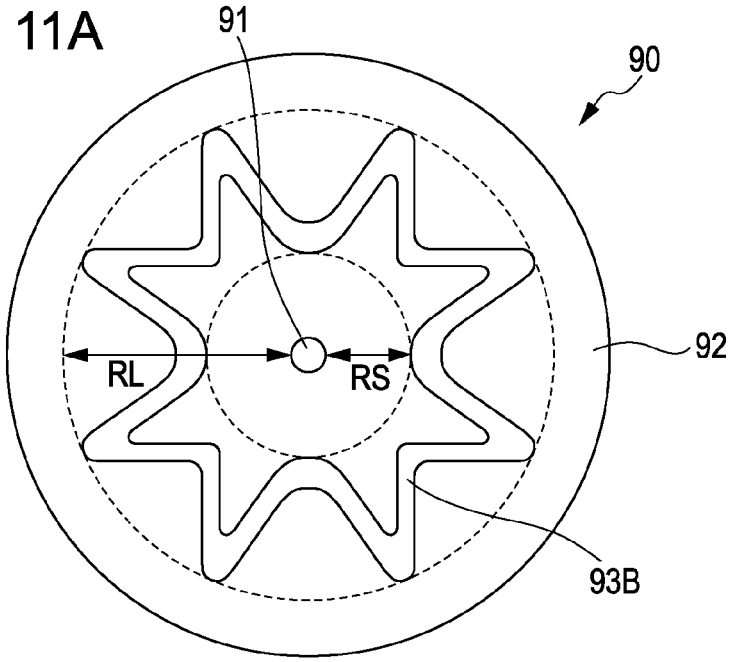
FIGS. 11A and 11B are plan views of the valve body.
Figure 11B:
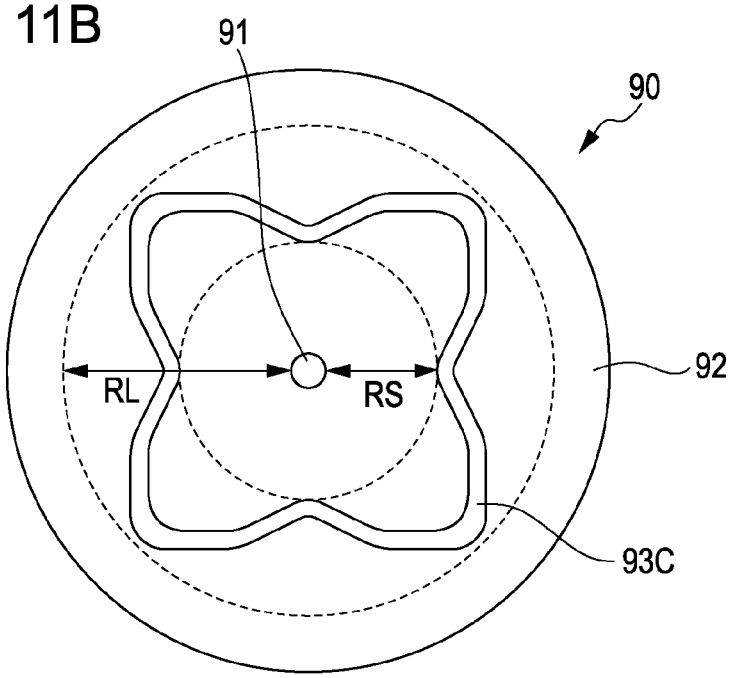

FIGS. 11A and 11B are plan views of the valve body. As shown in FIG. 11A, a seal member 93B is formed in a wave shape so as to surround the shaft section 91. In other words, the seal member 93B is formed in a wave shape configured of eight portions protruding to the shaft section 91 side and eight portions protruding from the shaft section 91 to the outside. In addition, the seal member 93B is line symmetrical with respect to two axes (not shown, similar to the dotted lines in FIG. 5) perpendicular to each other, which pass through the shaft section 91 (not shown, the same dotted line as FIG. 5A) on the upper surface of the flange section 92 that is a plane perpendicular to the shaft section 91.

When the seal member 93B is rotated due to the rotation of the valve body 90, a trace of the seal member 93B is shown in dotted lines. The inside dotted line is a circle having the radius RS which is the shortest distance between the shaft section 91 and the seal member 93B, and the outside dotted line is a circle having the radius RL which is the longest distance between the shaft section 91 and the seal member 93B. Accordingly, the region between two circles is a region where the upper surface of the seal member 93B passes through and accumulated ink 96 is formed on the opening edge 52*a* facing the region.

As described above, the seal member 93B is formed in the shape of the annulus of which the distance from the shaft section 91 is not constant. Accordingly, similar to the first embodiment, even though the ink is accumulated on the opening edge 52*a*, the ink spreads in the thickness direction. In other words, the accumulated ink 96 spreads at the region between the circle having the radius RL and the circle having the radius RS so that the ink is suppressed from being accumulated in the width direction. Accordingly, the influence of the accumulated ink 96 can be almost completely eliminated with respect to the operation in which the valve body 90 opens and closes the communication path 52.

Accordingly, the flow path member 30 is configured so that the operation of the valve body 90 can be stable without occurrence of the variation in the opening-closing operation of the valve body 90 and the ink can be stably supplied to the head body 19.

In addition, since the seal member 93B is formed line symmetrical with respect to two axes (not shown) perpendicular to each other, the bias force of the coil spring 94 is applied evenly to the entire seal member 93B and the sealing property with the opening edge 52*a* is improved.

As shown in FIG. 11B, a seal member 93C may be formed in a wave shape in which a center portion of each side having substantially rectangular shape is protruded to the shaft section 91 side. Even in such a shape, the same function effect as the seal member 93B shown in FIG. 11A is achieved.

Third Embodiment

In the first embodiment, the valve body 90 is rotated due to the up-down movement of the valve body 90 and the flow path member 30 may have a structure to promote the rotation of the valve body 90.

Figure 12:
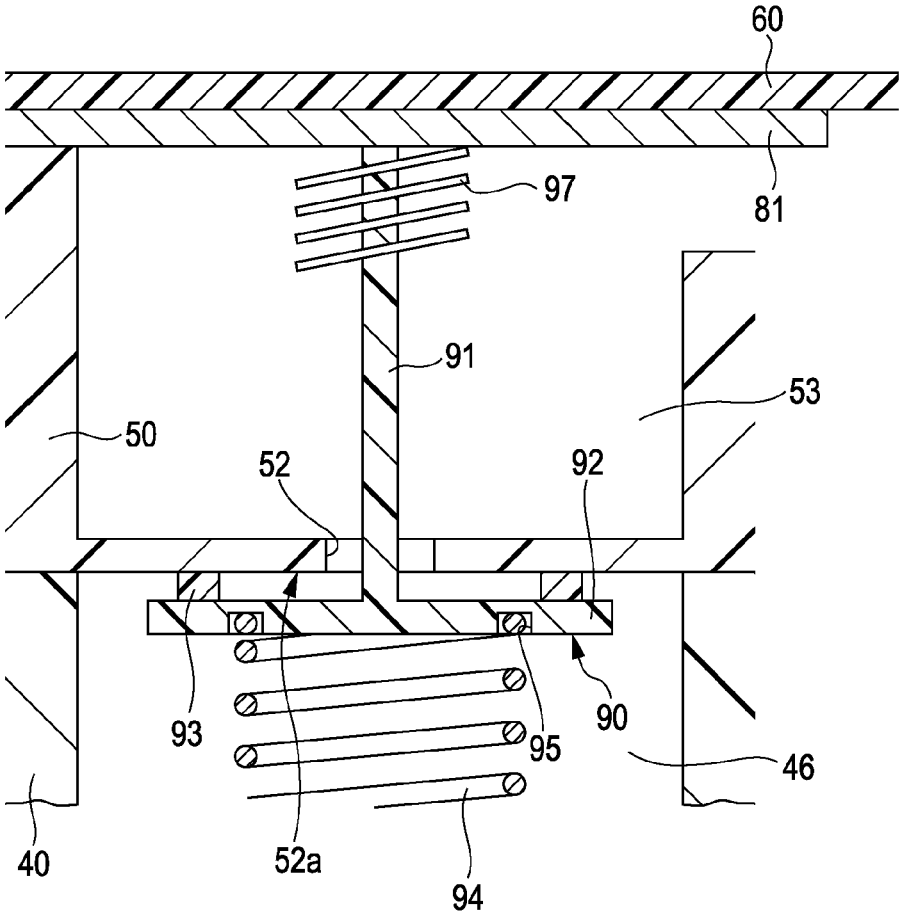
FIG. 12 is a cross-sectional view of a main portion illustrating the opening-closing operation of the valve body having a screw.
Figure 13:
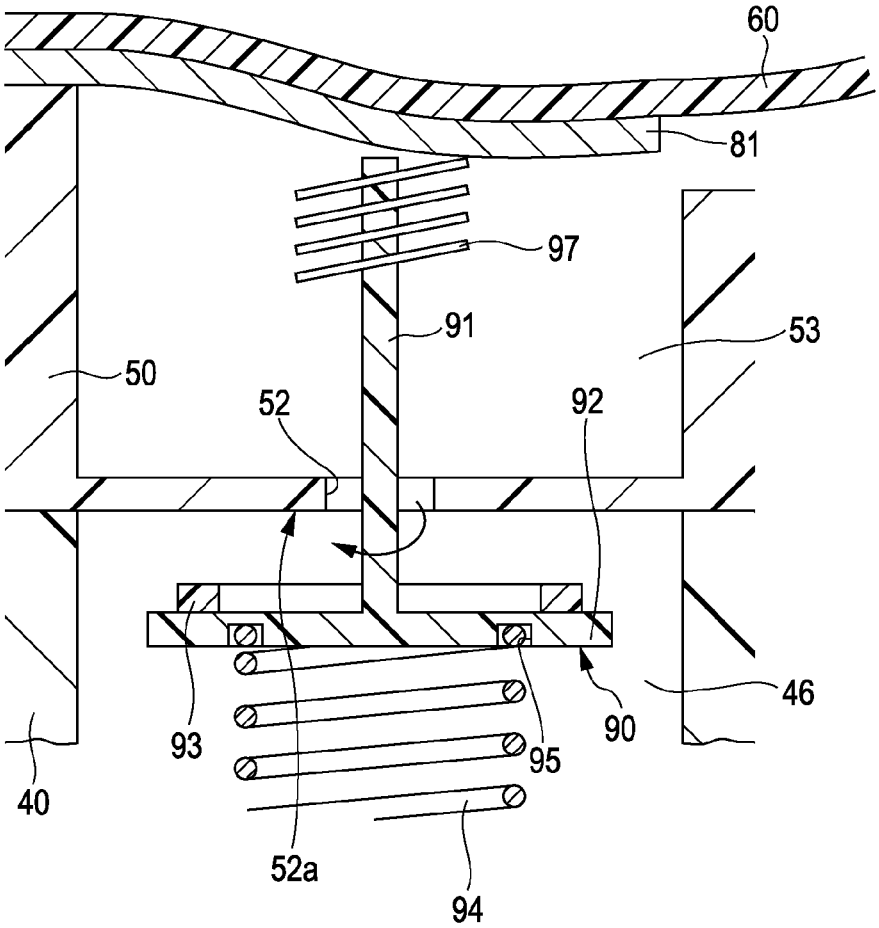
FIG. 13 is a cross-sectional view of a main portion illustrating the opening-closing operation of the valve body having the screw.
Figure 14:
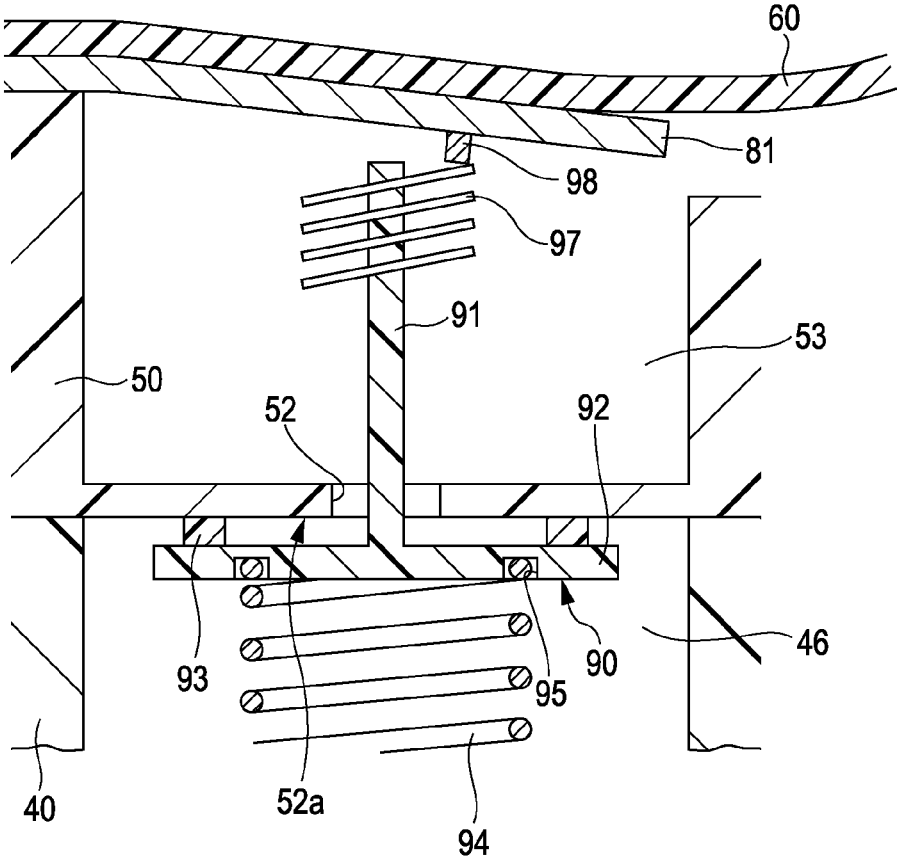
FIG. 14 is a cross-sectional view of a main portion illustrating the opening-closing operation of the valve body having the screw.

FIGS. 12 to 14 are cross-sectional views of a main portion for describing the opening-closing operation of the valve body having a screw. In addition, the same numbers are applied to the same members in the first embodiment and the duplicated descriptions are omitted.

The valve body 90 according to the embodiment has a screw 97 which is pressed by the pressure receiving member 80 (the operation plate 81) to the shaft section 91 and rotates the valve body 90. The screw 97 is a member which is formed in a spiral shape around the shaft section 91. In the embodiment, the screw 97 turns four times around the screw 91 and the top stage thereof comes in contact with the operation plate 81.

As shown in FIG. 13, the inside of the pressure chamber 53 becomes the negative pressure and when the film 60 is bent to the pressure chamber 53 side, the operation plate 81 is pressed by the film 60 and then is elastically deformed to the pressure chamber 53 side. The screw 97 is pressed by the elastic deformation of the operation plate 81 and the screw 97 rotates around the shaft section 91 due to the pressing force.

As described above, since the valve body 90 is rotated whenever the valve body 90 performs the up-down movement by providing the screw 97, the accumulated ink 96 formed by the seal member 93 can be further reliably spread and thinned.

In addition, as shown in FIG. 14, a protrusion section 98, which protrudes to the screw 97 side, may be provided on the operation plate 81. The pressing of the screw 97 according to the flexible deformation of the operation plate 81 can be further reliably performed by providing the protrusion section 98 on the operation plate 81.

Fourth Embodiment

In the third embodiment, in order to promote the rotation of the valve body 90, the pressing force of the operation plate 81 is acted on the valve body 90 and then the rotation thereof is promoted directly, however, the invention is not limited to the embodiment.

Figure 15:
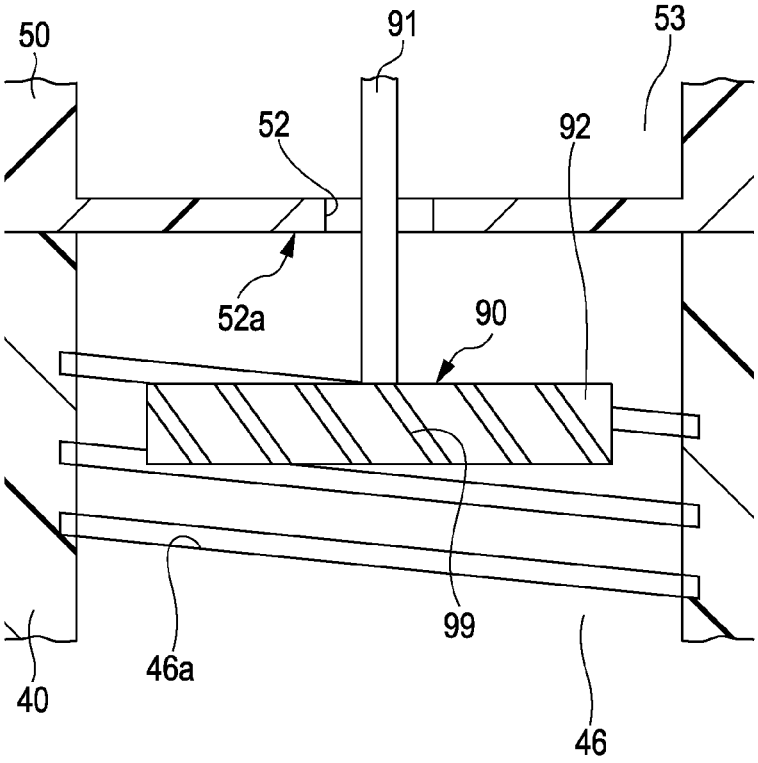
FIG. 15 is a cross-sectional view of a main portion illustrating the valve body and the valve body accommodating chamber.

FIG. 15 is a cross-sectional view of a main portion illustrating the valve body and the valve body accommodating chamber. In addition, the same numbers are applied to the same members in the first embodiment and the duplicated descriptions are omitted. In addition, the seal member 93, the coil spring 94 and the like are not shown in the drawing.

As shown in the same drawing, a groove 99, which receives the pressure of the ink and rotates the valve body 90, is provided on the side surface of the flange section 92 that is the side surface of the valve body 90. Specifically, the groove 99 is extended perpendicular to the shaft section 91, rather than in a direction parallel to the shaft section 91.

As described above, the ink, which flows from the valve body accommodating chamber 46 to the communication path 52, flows into the groove 99 by providing the groove 99 on the side surface of the flange section 92. Thus, the pressure of the ink presses the side surface of the groove 99 and then the valve body 90 is rotated. As described above, the valve body 90 is rotated by the pressure of the ink flowed in the groove 99 so that the accumulated ink 96 formed by the seal member 93 can be further reliably spread and thinned.

Furthermore, a groove 46*a*, which makes the ink to be circled from the valve body accommodating chamber 46 to the communication path 52, may be provided on the side surface of the valve body accommodating chamber 46. Specifically, the spiral groove 46*a* is provided on the side surface of the valve body accommodating chamber 46.

The ink, which flows from the valve body accommodating chamber 46 to the communication path 52, is circled by providing the groove 46*a* on the side surface of the valve body accommodating chamber 46. The valve body 90 is rotated by the circling flow of the ink. As described above, the valve body 90 is rotated by the circling flow of the ink, which is produced by the groove 46*a* so that the accumulated ink 96, which is formed by the seal member 93, can be further reliably spread and thinned.

Fifth Embodiment

Figure 16A:
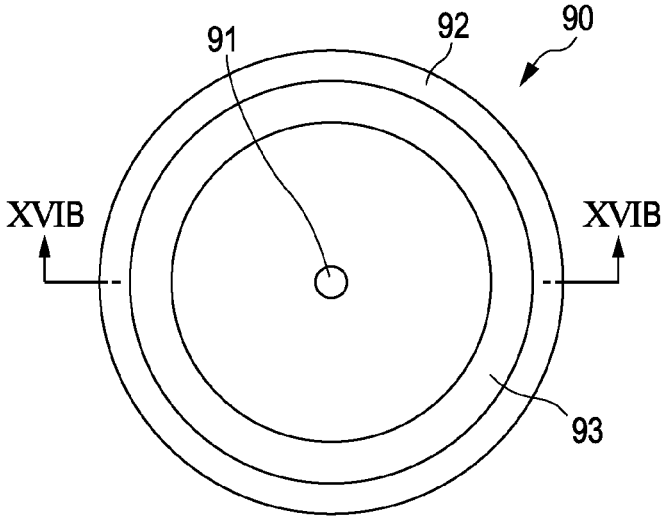
FIG. 16A is a plan view of the valve body and FIG. 16B is a cross-sectional view of the valve body taken along the line XVIB-XVIB in FIG. 16A.

In the first embodiment, the seal member 93, which is formed in the shape of the annulus of which the distance is not constant from the shaft section 91, is exemplified as the seal member having an oval shape. However, the seal member 93 is not limited to this shape. For example, the shape shown in FIG. 16 may be provided. Furthermore, other embodiments of the seal member are described below.

FIG. 1 is a plan view of an ink jet type recording apparatus. As shown in FIG. 1, an ink jet type recording apparatus 11 includes a body frame 12 having a rectangular shape in plan view. A platen 13 is extended in the right-left direction which is a main scanning direction in the body frame 12. On the platen 13, a recording sheet (not shown) is fed by a paper feeding mechanism (not shown) along the front-back direction which is a sub-scanning direction. In addition, a rod-shaped guide shaft 14, which is extended parallel in the longitudinal direction (the right-left direction) of the platen 13, is provided in a hanging manner at the upper side of the platen 13 in the body frame 12.

A carriage 15 is supported on the guide shaft 14 in a state where reciprocating movement thereof is possible along the guide shaft 14. The carriage 15 is connected to a carriage motor 17, which is provided at a back surface of the body frame 12, via an endless timing belt 16 hung between a pair of pulleys 16*a* which is provided in the inside of back wall of the body frame 12. Accordingly, the carriage 15 is reciprocated along the guide shaft 14 by the drive of the carriage motor 17.

A recording head 18 is supported at a lower end side facing the platen 13 in the carriage 15. The recording head 18 includes a head body 19 ejecting the ink and a flow path member 30 supplying the ink from the ink cartridge 22 to the head body 19.

Plural nozzles (not shown) are opened to the lower surface of a head body 19. Ink droplets are ejected respectively from each nozzle to a recording paper (not shown) fed on the platen 13 by driving a piezoelectric element (not shown) provided in the head body 19 and then the printing is performed.

A carriage holder 21 is provided on a right end portion in the body frame 12 and plural ink cartridges 22 are detachably mounted on the carriage holder 21 as a liquid supply source. In the embodiment, five ink cartridges 22 are provided. Different (color) types of ink are accommodated in each ink cartridge 22.

Each ink cartridge 22 mounted on the carriage holder 21 is connected to the flow path member 30 via each ink supply tube 24. Each color of ink, which is supplied from each ink cartridge 22 via each ink supply tube 24, is temporarily stored in the flow path member 30. Each color of ink temporarily stored individually is supplied to the head body 19.

A maintenance unit 26 for performing maintenance such as cleaning of the head body 19 is provided at a home position region of the carriage 15, that is, at a position closer to the right end portion in the body frame 12. The maintenance unit 26 includes a cap 27 which comes in contact with the head body 19 so as to surround the opening of each nozzle of the head body 19 and accommodates the ink ejected by flushing from the opening of each nozzle, and a suction pump (not shown) which is capable of suctioning the inside of the cap 27.

Thus, thickened ink, bubbles or the like is forcibly discharged from the opening of each nozzle into the cap 27, that is, a so-called cleaning is performed, by suctioning the inside of the cap 27 using a suction pump (not shown) in a state where the head body 19 comes in contact with the cap 27 so as to surround the opening of each nozzle of the head body 19.

FIG. 2 is a plan view of the flow path member (in a state where a cover member and a film are removed) according to the embodiment, FIG. 3 is a plan view of a first flow path member 40 according to the embodiment and FIG. 4 is a cross-sectional view taken along the line IV-IV in FIG. 2.

As shown in the drawings, the flow path member 30 includes a square box-shaped holding member 31 having a bottom, a cover member 32 capable of sealing an upper opening of the holding member 31, a first flow path member 40 and a second flow path member 50 which are received in the holding member 31.

An inner bottom surface of the holding member 31 and a lower surface of the first flow path member 40, an upper surface of the first flow path member 40 and a lower surface of the second flow path member 50, and an upper surface of the holding member 31 and a lower surface of the cover member 32 are respectively bonded to each other by an adhesive. In addition, the holding member 31, the cover member 32, the first flow path member 40 and the second flow path member 50 have stiffness and are configured of a synthetic resin through which the liquid does not pass.

As shown in FIG. 3, plural filter chamber concave sections 41 are provided in the front end side (an end portion in the front direction) on the upper surface of the first flow path member 40. In the embodiment, five filter chamber concave sections 41 are arranged in a line in the right-left direction depending on the type of ink used.

In addition, valve body concave sections 43, in which valve bodies 90 (described in detail below) are disposed, are provided in a line in the right-left direction at the back end side (at end portion in the back direction) in the inner bottom surface of the first flow path member 40. In the embodiment, one valve body concave section 43 is provided on one filter chamber concave section 41 and a total of five valve body concave sections 43 is provided in a line in the right-left direction.

As shown in FIGS. 2 to 4, a filter chamber 44 and a valve body accommodating chamber 46 are formed by laminating the second flow path member 50 on the upper surface of the first flow path member 40.

The filter chamber 44 is a space surrounded by each filter chamber concave sections 41 and the second flow path member 50, and in the embodiment, five filter chambers 44 are formed. In addition, the valve body accommodating chamber 46 is a space surrounded by the valve body concave sections 43 and the second flow path member 50, and in the embodiment, five valve body accommodating chambers 46 are formed.

A filter 45 has substantially the same shape as the opening shape of the filter chamber concave sections 41 and is arranged so as to cross in the up-down direction in which the ink of the filter chamber concave section 41 flows. A foreign material or the like, which is included in each ink flowing from the upstream side, is removed using the filter 45. In addition, the filter 45 may be formed by finely weaving metal or may be formed of a metal plate or a nonwoven fabric where fine single hole is provided.

An outlet hole 47 is opened to the bottom surface of each filter chamber 44 so as to drain the ink, in which the foreign material or the like is removed by the filter 45, to the head body 19 (see FIG. 1) side positioned at the downstream side. The outlet hole 47 communicates with a communicating hole 33 that is a through hole formed on the bottom surface of the holding member 31, and the ink is drained to the head body 19 via the communicating hole 33.

In addition, an ink introduction path 48, in which the ink supplied from the ink supply tube 24 (see FIG. 1) is introduced, is formed at the first flow path member 40. An opening of one side of the ink introduction path 48 is formed on the upper surface of the first flow path member 40 and an opening of the other side is formed on the bottom surface of the valve body accommodating chamber 46.

Five groove-shaped flow paths 51, which configure a portion of the liquid flow path formed on the flow path member 30, are extended in the front-back direction on the upper surface of the second flow path member 50. In the embodiment, five groove-shaped flow paths 51 are provided having substantially the same length as each other in the front-back direction.

The groove-shaped flow path 51 is extended from a region facing the valve body accommodating chamber 46 of the second flow path member 50 to a region facing the filter chamber 44. The back end side of the groove-shaped flow paths 51 communicates with the valve body accommodating chamber 46 via a communication path 52. The front end side of the groove-shaped flow paths 51 communicates with the filter chamber 44 via the communication path 55.

A film (a flexible member) 60 made of a synthetic resin having flexibility is provided on the upper surface of the second flow path member 50.

The film 60 seals the upper opening of the groove-shaped flow paths 51 and a pressure chamber 53 is a space formed by the film 60 and the groove-shaped flow paths 51. The region facing the groove-shaped flow paths 51 of the film 60, in other words, the region configuring one surface of a pressure chamber 53 is referred to as a pressure receiving section 61. The opening shapes of each of groove-shaped flow paths 51 are the same as each other so that the pressure receiving sections 61 also have the same shape as each other. The pressure receiving section 61 of the film 60 is elastically deformed by difference between the atmosphere and the pressure in the pressure chamber 53. Since the pressure in the pressure chamber 53 becomes negative with respect to the atmosphere, the pressure receiving section 61 is flexed to the inner side of the pressure chamber 53.

In the embodiment, the film 60 is one sheet of film covering the entire upper surface of the second flow path member 50. The film 60 is bonded to the opening edge of the groove-shaped flow paths 51 of the upper surface of the second flow path member 50 using an adhesive 70. Of course, the film 60 may be bonded to the entire upper surface of the second flow path member 50 using an adhesive, and not just the opening edge. In addition, the film 60 does not need to be formed in one sheet and may be formed for each groove-shaped flow path 51.

As described above, the liquid flow path configured of the ink introduction path 48, the valve body accommodating chamber 46, the communication path 52, the pressure chamber 53, the communication path 55, the filter chamber 44, the outlet hole 47 and the communicating hole 33 is provided on the flow path member 30. The ink supplied from each ink supply tube 24 (see FIG. 1) flows in the liquid flow path of the flow path member 30 and then is supplied to the head body 19. In addition, the communication path 52 corresponds to a communication path communicating with the groove-shaped flow path (the pressure chamber) disclosed in the claims.

A pressure receiving member 80 is arranged between the second flow path member 50 and the film 60. The pressure receiving member 80 is displaced by receiving a pressing force from the film due to the displacement of the film toward the pressure chamber 53 side and is intended to press a valve body 90 described below.

Specifically, the pressure receiving member 80 is configured of five operation plates 81 and a base end section 82 to which each of the operation plates 81 is commonly connected. The material of the pressure receiving member 80 is not specifically limited and in the embodiment, the pressure receiving member 80 is formed of one sheet of a thin plate made of a stainless steel having appropriate elasticity. The operation plates 81 is formed in such a manner that the width thereof is slightly narrower than that of the pressure chamber 53 and the length thereof is long in the front-back direction.

The pressure receiving member 80 is bonded to the upper surface of the second flow path member 50 at the base end section 82 and the upper surface thereof is covered by the film 60. Thus, the base end section 82 of the pressure receiving member 80 is pinched between the second flow path member 50 and the cover member 32. In addition, each of operation plates 81 is arranged so as to face the pressure receiving section 61 in plan view and is separated from the bottom portion of the groove-shaped flow paths 51. In other words, the pressure receiving member 80 has a cantilever structure in which the base end section 82 is a fixed end and the operation plate 81 is a free end.

The valve body 90 is provided below the pressure receiving member 80. The valve body 90 is configured in such a manner that it is possible for the valve body 90 to enter a valve closing state in which the ink does not flow in the pressure chamber 53 and enter a valve opening state in which the ink flows in the pressure chamber 53, and the valve body 90 is biased so as to be in the valve closing state.

The valve body 90 is described in detail using FIGS. 4 to 6 and FIGS. 16A and 16B. FIGS. 5A and 5B, and FIGS. 16A and 16B are a plan view and a cross-sectional view of the valve body, respectively, and FIGS. 6A and 6B are cross-sectional views of a main portion of illustrating the opening-closing operation of the valve body, respectively.

As shown in FIG. 4, the valve body 90 includes a cylindrical shaft section 91, a disc-shaped flange section 92 and a seal member 93. The flange section 92 is an example of the valve main body in the claims. The outer diameter of the shaft section 91 is smaller than the inner diameter of the communication path 52 and the shaft section 91 is inserted through the communication path 52. In addition, the outer diameter of the flange section 92 is larger than the inner diameter of the communication path 52 and the flange section 92 is arranged in the valve body accommodating chamber 46. The lower end of the shaft section 91 is connected to the center of the upper surface of the flange section 92 and the upper end of the shaft section 91 comes in contact with the lower surface of the operation plate 81. The material of the valve body 90 is not particularly limited and for example, it may be formed from a synthetic resin. In addition, the shaft section 91 and the flange section 92 may be integrally formed, or may be separately formed and then these may be bonded.

In addition, the film 60 does not need to come in constant contact with the operation plate 81, and if the operation plate 81 is pressed due to the displacement of the film 60, the film 60 and the operation plate 81 may be separated. Similarly, if the valve body 90 is pressed due to the displacement of the operation plate 81, the operation plate 81 does not need to come in contact with the valve body 90 and they may be separated.

As shown in FIGS. 5A and 5B, 16A and 16B, the seal member 93 is fixed to the upper surface of the flange section 92. The seal member 93 is continued without a break so as to surround the shaft section 91 and is formed in the shape of the annulus around the shaft section 91. In addition, the height (the height from the upper surface of the flange section 92) of the seal member 93 is constant.

The seal member 93 is mainly formed of the elastic material and when the valve body 90 is the valve closing state, the seal member 93 comes in contact with the opening edge 52*a* (see FIG. 4) of the communication path 52, and seals between the flange section 92 and the opening edge 52*a*. In addition, the material of the seal member 93 or the like is described in detail below.

Figure 16B:
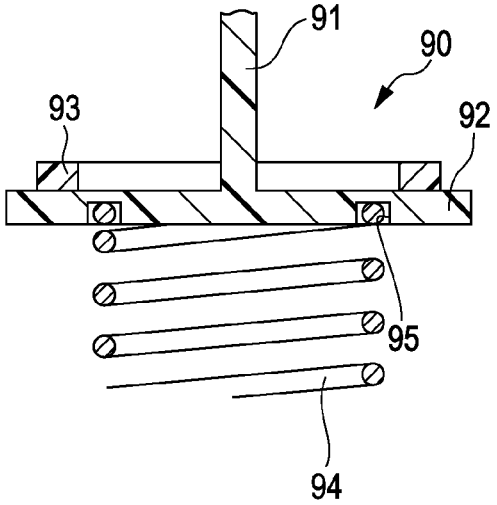

In addition, as shown in FIGS. 4, 5B and 16B, the coil spring 94, which is an example of a biasing member, is intervened between the lower surface of the flange section 92 and the bottom surface of the valve body accommodating chamber 46. One end of the coil spring 94 is fixed to the bottom surface of the valve body accommodating chamber 46 and the other end thereof is fit to a groove 95 provided on the lower surface of the flange section 92. Accordingly, the entire valve body 90 can move up and down due to the expansion and contraction of the coil spring 94.

The opening-closing operation of the valve body 90 having such a configuration is described. As shown in FIG. 6A, the coil spring 94 is biased upwards which makes the valve body 90 to always be in the valve closing state. Thus, in the valve closing state of the valve body 90, the seal member 93 closely comes in contact with the opening edge 52*a* of the communication path 52 in a state of surrounding the communication path 52. Accordingly, the communication path 52 is closed, that is, the inside of the valve body accommodating chamber 46 and the inside of the pressure chamber 53 are in a non-communication state. As described above, the seal member 93 are mainly formed of the elastic material. Thus, the seal member 93 comes in close contact with the opening edge 52*a* by the elasticity so that the non-communication state can be reliably maintained.

In a state where the ink is supplied to the liquid flow path with initial charging or with ejecting of the ink before present time, when each ink is ejected from the head body 19 (see FIG. 1), the ink in each pressure chamber 53 decreases. Accordingly, each pressure chamber 53 becomes a negative pressure due to the pressure difference with the atmosphere, and then the pressure receiving section 61 (see FIG. 4) is displaced to be bent to the pressure chamber 53 side (the lower side). Each operation plate 81 (see FIG. 4) is pressed by the pressure receiving section 61 and then is elastically deformed. Further, each valve body 90 is pressed by the operation plate 81 and then each valve body 90 is pushed down.

As shown in FIG. 6B, when the valve body 90 is pushed down against the bias force of the pressure coil spring 94, the valve body 90 becomes the valve opening state. In other words, the seal member 93 is separated from the opening edge 52*a* and then the valve body 90 is opened. Thus, when the valve body 90 is the valve opening state, the communication path 52 is opened, that is, the inside of the valve body accommodating chamber 46 and the inside of the pressure chamber 53 become the communication state.

When the valve body 90 is the valve opening state, the ink in each valve body accommodating chamber 46 flows in each pressure chamber 53 via the communication path 52. Thus, when the ink is sufficiently replenished in each pressure chamber 53, the negative pressure in each pressure chamber 53 is eliminated and then each pressure receiving section 61 and each operation plate 81 return to their respective original positions. In addition, each valve body 90 is the valve closing state respectively due to the bias force of each coil spring 94 and then each pressure chamber 53 is always maintained at a constant pressure.

Here, the seal member 93 is described in detail. The seal member 93 is formed including an elastic material and a water-repellent resin. The elastic material may include an elastomer. Of course, the material is not limited to the elastomer and may use a resin having an elastic modulus lower than that of the resin which forms the valve body 90 such as the flange section 92 and the shaft section 91.

Meanwhile, the water-repellent resin may include silicon oil or a fluorine resin. Both the silicon oil and the fluorine resin have water-repellency with respect to the ink (the liquid). The water-repellent resin is kneaded in the elastic material and is molded as the seal member 93. The water-repellent resin has a property to be dissociated to the outside due to the pressure applied to the seal member 93.

In addition, it is preferable that the contact angle of the water-repellent resin with the ink be 60 degrees or greater. It is preferable that the water-repellent resin according to the invention have the contact angle at least equal to or greater than the contact angle of the surface of the valve body 90 side of the second flow path member 50, that is, the surface of the opening edge 52*a* facing the seal member 93.

The valve body 90 described above may be formed by two-color molding with the shaft section 91 and the flange section 92 formed from a synthetic resin, and the seal member 93 formed from the elastic material and the water-repellent resin. Accordingly, the valve body 90, in which a bonding strength between the seal member 93 and the flange section 92 is improved, may be obtained. In addition, the valve body 90 is not limited to the embodiments described above and the shaft section 91, the flange section 92 and the seal member 93 may also be integrally molded with the elastic material and the water-repellent resin as a raw material. Accordingly, the production of the valve body 90 can be simplified. Of course, the seal member 93 and the flange section 92 are formed separately and then the valve body 90 may be formed by bonding the seal member 93 and the flange section 92. In addition, the silicon oil and the fluorine resin may be kneaded into the elastic material independently and respectively, and these may be combined thereby kneading into the elastic material.

Figure 17A:
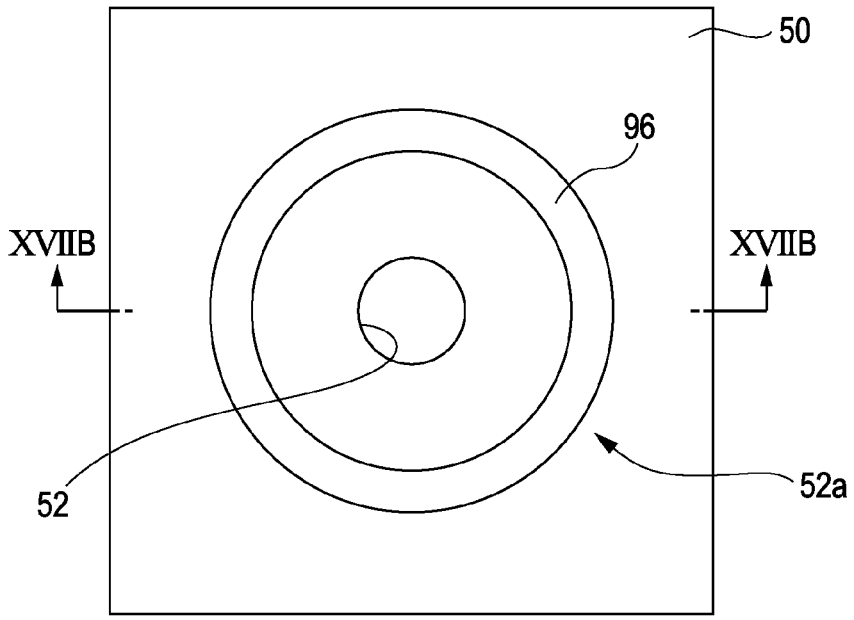
FIG. 17A is a plan view of the communication path which is seen from the valve body accommodating chamber side and FIG. 17B is a cross-sectional view of the communication path taken along the line XVIIB-XVIIB in FIG. 17A.

That accumulation of the ink on the opening edge 52*a* is suppressed by the seal member 93 described above is described in detail. FIG. 17A is a plan view of the communication path 52 communicating with the pressure chamber 53, which is seen from the valve body accommodating chamber 46 side, FIG. 17B is a cross-sectional view taken along the line XVIIB-XVIIB in FIG. 17A.

Figure 17B:
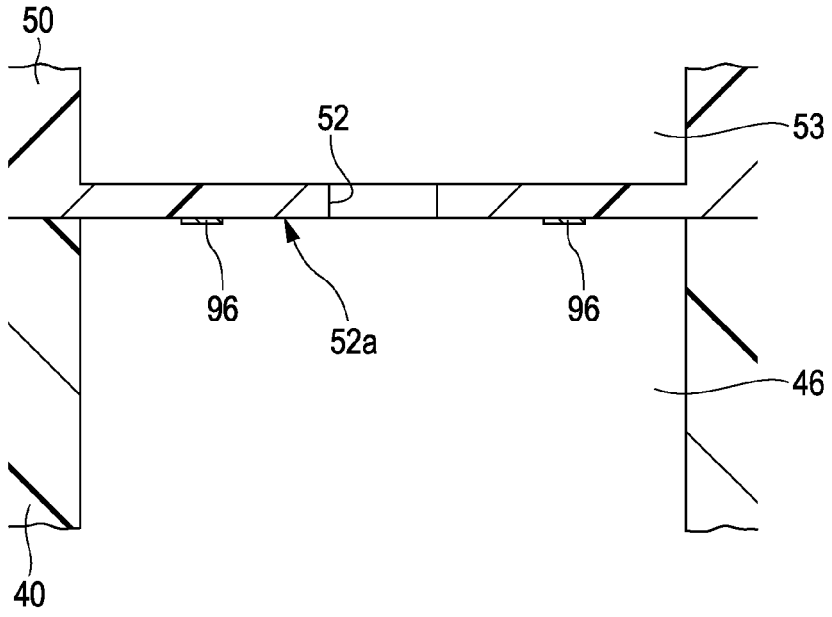

As shown in FIGS. 17A and 17B, the seal member 93 (see FIGS. 5A and 5B) comes in contact with the opening edge 52*a* by the opening-closing operation of the valve body 90 (see FIGS. 4 to 6B). As described above, the seal member 93 is formed including the water-repellent resin and the water-repellent resin to be dissociated to the outside due to the pressure applied to the seal member 93. Accordingly, the water-repellent resin to be dissociated from the seal member 93 which is pressed to the opening edge 52*a* due to the bias force of the coil spring 94. The dissociated water-repellent resin is attached to the opening edge 52*a* side.

Hereinafter, the water-repellent resin to be dissociated from the seal member 93 is continuously attached to the opening edge 52*a* whenever the valve body 90 repeats the opening-closing operation. As a result, the water-repellent resin to be dissociated from the seal member 93 is attached to the opening edge 52*a* in the same shape as the annular seal member 93. The water-repellent resin attached to the opening edge 52*a* is referred to as an attached resin 96.

The annular attached resin 96 is formed at the region facing the seal member 93 of the opening edge 52*a*. The attached resin 96, that is, the water-repellent resin has water-repellency with respect to the ink so that due to the water-repellent resin, the surface of the opening edge 52*a* has the same effect as that in which the water-repellent treatment is performed by the water-repellent resin. As described above, since the surface of the opening edge 52*a* is covered by the water-repellent resin, it is possible to prevent the ink from adhering to the surface of the opening edge 52*a*.

Figure 18A:
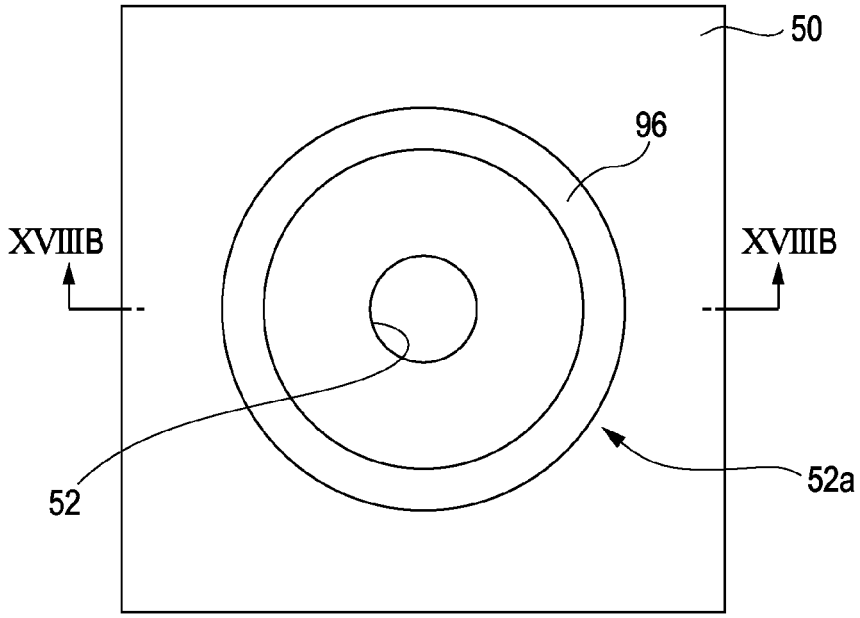
FIG. 18A is a plan view of the communication path which is seen from the valve body accommodating chamber side and FIG. 18B is a cross-sectional view of the communication path taken along the line XVIIIB-XVIIIB in FIG. 18A.
Figure 18B:
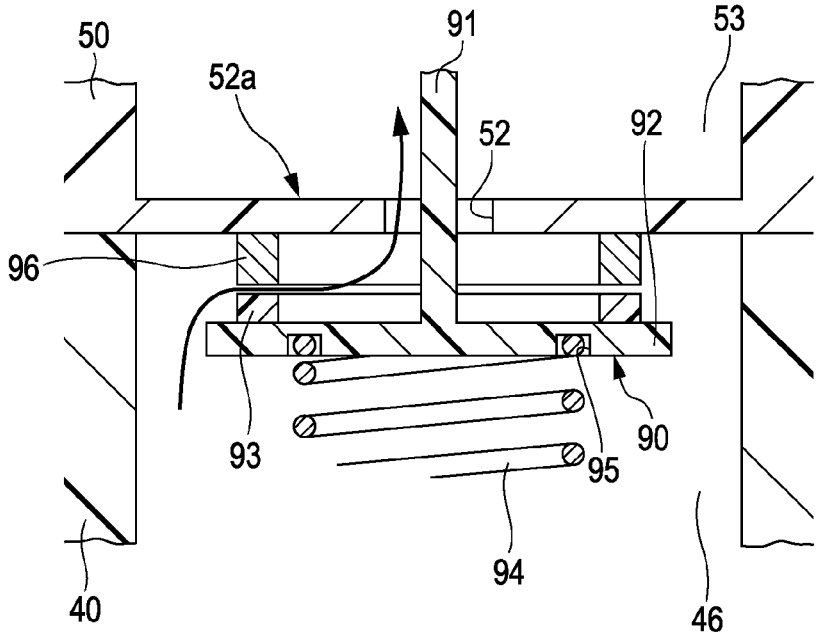

Supposedly, when the seal member 93 does not include the water-repellent resin, as shown in FIGS. 18A and 18B, the ink is accumulated on the opening edge 52*a*. The accumulated ink is referred to as an accumulated ink 96. FIG. 18A is a plan view of the communication path 52 communicating with the pressure chamber 53, which is seen from the valve body accommodating chamber 46 side and FIG. 18B is a cross-sectional view taken along the line XVIIIB-XVIIIB.

As shown in FIGS. 18A and 18B, when the seal member 93 is repeatedly contacted and separated from the opening edge 52*a* by the opening-closing operation of the valve body 90, since water-repellency is applied to the opening edge 52*a*, the ink begins to be gradually fixed. Furthermore, when the opening-closing operation of the valve body 90 is repeated, the ink is accumulated relatively thick and narrow.

Thus, variation occurs in the opening-closing operation of the valve body 90. For example, even though degrees of the pressure variation inside the pressure chamber 53 are the same as each other, since the accumulated ink 96 is formed relatively thick, the opening degrees of the valve body 90 are different to each other. As a result, the supply of the ink to the head body 19 is unstable, the ejection property of the ink is varied and the printing quality is degraded. In addition, when the accumulation of the ink is further advanced, as shown in FIG. 18B, the variation of the thickness of the accumulated ink 96 becomes significant and even when the valve body 90 closes the communication path; the sealing is incomplete due to the seal member 93. In this case, there is concern that the ink may flow in the pressure chamber 53 from the valve body accommodating chamber 46 and the ink may be discharged from the nozzles of the head body 19 at an unintended timing.

Meanwhile, as described above, in the flow path member 30 according to the invention, since the seal member 93 is formed including the water-repellent resin, the water-repellent resin is attached to the opening edge 52*a* facing the seal member 93 by the opening-closing operation of the valve body 90. Thus, as shown in FIGS. 7A to 7C, ink attaching to the opening edge 52*a* is suppressed. Accordingly, it is possible to almost completely eliminate the influence of the accumulated ink 96 with respect to the opening-closing operation of the valve body 90.

Accordingly, the flow path member 30 is configured in such a manner that the variation does not occur in the opening-closing operation of the valve body 90, the operation of the valve body 90 can be stable and the ink can be stably supplied to the head body 19.

Thus, according to the recording head 18 and the ink jet type recording apparatus 11 including the flow path member 30 and the head body 19, since the ink is stably supplied to the head body 19 using the flow path member 30 as described above, the variation in the ejecting speed of the ink ejected from the nozzle or in the weight of the ink droplets which are ejected via each liquid flow path can be suppressed. Accordingly, the ejection characteristics of the ink are improved so that the recording head 18 and the ink jet type recording apparatus 11, which can perform high quality printing, is provided.

In addition, since the flow path member 30 according to the invention includes the water-repellent resin in the seal member 93, the water-repellent treatment may be unnecessary on the opening edge 52*a* of the second flow path member 50 facing the seal member 93.

For example, there is a need to mask on a portion where the water-repellent treatment is not performed when the water-repellent treatment is performed only on the opening edge 52*a* of the second flow path member 50. In this case, for the process of formation of the second flow path member 50, the masking treatment and the water-repellent treatment on the second flow path member 50 are newly required. Meanwhile, when the masking treatment is omitted and the water-repellent treatment is performed the entire surface of the second flow path member 50 including the surface of the opening edge 52*a*, the water-repellent treatment is also performed on an unnecessary portion.

In the invention, since it is unnecessary to perform the water-repellent treatment on the opening edge 52*a* of the second flow path member 50 facing the seal member 93, cost or labor relating to the formation of the flow path member 30 can be reduced.

In addition, the water-repellent treatment may be performed on the opening edge 52*a* of the second flow path member 50 facing the seal member 93. In this case, the ink becoming fixed to the opening edge 52*a* can be further reliably prevented by applying the water-repellent treatment in advance on the opening edge 52*a* and by attaching the water-repellent resin to be dissociated from the seal member 93 to the opening edge 52*a*.

Other Embodiments

The ink used in the invention is not particularly limited and both pigment-based ink and dye-based ink can be applied to the invention. In addition, even though the liquid other than the ink is used, the liquid can be applied to the invention if the liquid is accumulated on the opening edge 52*a* of the communication path 52 by the opening-closing operation of the valve body 90.

In addition, in the ink jet type recording apparatus 11, it is exemplified that the recording head 18 is mounted on the carriage 15 and moves in the main scanning direction, however, the invention is not particularly limited to the embodiment. For example, the invention may be applied to a so-called line-type recording apparatus in which the printing is performed by fixing the recording head 18 and by moving only the recording sheet such as a paper in the sub-scanning direction.

In addition, in each of embodiments described above, the ink jet type recording head as an example of the liquid ejecting head and the ink jet type recording apparatus as an example of the liquid ejecting apparatus are described, however, the invention is widely intended for a general liquid ejecting head and liquid ejecting apparatus. Of course, the invention can be applied to a liquid ejecting head or a liquid ejecting apparatus which ejects liquid other than the ink. The invention may be applied to a liquid ejecting apparatus including other liquid ejecting heads. The other liquid ejecting heads may include for example, various recording heads used in an image recording apparatus such as a printer, a color material ejecting head used in manufacturing a color filter such as a liquid crystal display, an electrode material ejecting head used in electrode formation of an organic EL display, a FED (an electric field emission display) or the like, a bioorganic matter ejecting head used in manufacturing bio-chips, or the like.

The entire disclosure of Japanese Patent Application Nos. 2011-286919 and 2011-286918, filed Dec. 27, 2011 are incorporated by reference herein.

What is claimed is:

1. A flow path member comprising:

a liquid flow path through which a liquid flows;

a groove-shaped flow path configuring a portion of the liquid flow path and a communication path communicating with the groove-shaped flow path;

a flexible member which forms a pressure chamber in the groove-shaped flow path by sealing an opening of the groove-shaped flow path and is flexibly deformed by pressure variation inside the pressure chamber;

a valve body which has a shaft section inserted through the communication path and a valve main body provided on the shaft section, is able to enter a valve closing state in which the valve main body closes the communication path and a valve opening state in which the valve main body is separated from the communication path, and is biased to be in the valve closing state; and a pressure receiving member which is displaced by receiving a pressing force from the flexible member due to displacement of the flexible member to the pressure chamber side and then is able to press the shaft section in a direction where the valve body enters the valve opening state, wherein the valve body is able to rotate around the shaft center, the valve main body is provided with a seal member, which comes in contact with an opening edge of the communication path, and the seal member is formed in a shape of an annulus of which a distance from the shaft section is not constant.

2. The flow path member according to claim 1, wherein the seal member is formed so as to pass through the shaft section in a plane perpendicular to the shaft section and to be line symmetrical with respect to two shafts perpendicular to each other.

3. A liquid ejecting head comprising:

the flow path member according to claim 2; and a head main body ejecting the liquid supplied from the flow path member.

4. The flow path member according to claim 1, wherein the seal member is formed in a shape of the annulus and the center of the annulus is shifted from the shaft section.

5. A liquid ejecting head comprising:

the flow path member according to claim 4; and a head main body ejecting the liquid supplied from the flow path member.

6. The flow path member according to claim 1, wherein the seal member is formed in a wave shape configured of a portion protruding to the shaft section side and a portion protruding outwardly further than the shaft section.

7. A liquid ejecting head comprising:
the flow path member according to claim 6; and
a head main body ejecting the liquid supplied from the flow path member.

8. The flow path member according to claim 1,
wherein the shaft section is provided with a screw which is pressed against the pressure receiving member and then rotates the valve body.

9. A liquid ejecting head comprising:
the flow path member according to claim 8; and
a head main body ejecting the liquid supplied from the flow path member.

10. The flow path member according to claim 1,
wherein the valve body is provided with a groove which receives the pressure of the liquid in the liquid flow path and then rotates the valve body on the side surface thereof.

11. A liquid ejecting head comprising:
the flow path member according to claim 10; and
a head main body ejecting the liquid supplied from the flow path member.

12. The flow path member according to claim 1,
wherein the liquid flow path includes a valve body accommodating chamber which communicates with the communication path so as to accommodate the valve body, and
the valve body accommodating chamber is provided with a groove in which the liquid circles from the valve body accommodating chamber to the communication path on the side surface thereof.

13. A liquid ejecting head comprising:
the flow path member according to claim 12; and
a head main body ejecting the liquid supplied from the flow path member.

14. A liquid ejecting head comprising:
the flow path member according to claim 1; and
a head main body ejecting the liquid supplied from the flow path member.

15. A liquid ejecting apparatus comprising:
the liquid ejecting head according to claim 14.

16. A flow path member comprising:
a liquid flow path through which a liquid flows;
a groove-shaped flow path configuring a portion of the liquid flow path and a communication path communicating with the groove-shaped flow path;
a flexible member which forms a pressure chamber in the groove-shaped flow path by sealing an opening of the groove-shaped flow path and is flexibly deformed by pressure variation inside the pressure chamber;
a valve body which has a shaft section inserted through the communication path and a valve main body provided on the shaft section, is able to enter valve closing state in which the valve main body closes the communication path and a valve opening state in which the valve main body is separated from the communication path, and is biased to be in the valve closing state; and
a pressure receiving member which is displaced by receiving a pressing force from the flexible member due to displacement of the flexible member to the pressure chamber side and then is able to press the shaft section in a direction where the valve body enters the valve opening state,
wherein the valve main body is provided with a seal member which comes in contact with the opening edge of the communication path, and
the seal member includes a water-repellent resin to be dissociated when the opening edge is sealed in the valve opening state of the valve body.

17. The flow path member according to claim 16,
wherein water-repellent treatment is applied on a surface of an opening edge of the communication path.

18. The flow path member according to claim 16,
wherein the valve body and the seal member are two-color molded.

19. The flow path member according to claim 16,
wherein the valve body and the seal member are integrally molded.

20. The flow path member according to claim 16,
wherein the water-repellent resin is silicon oil or fluorine resin.

* * * * *